US008682230B2

(12) United States Patent
Taguchi et al.

(10) Patent No.: US 8,682,230 B2
(45) Date of Patent: Mar. 25, 2014

(54) DEVELOPMENT DEVICE, PROCESS CARTRIDGE, AND IMAGE FORMING APPARATUS INCLUDING SAME HAVING MULTIPLE RECESSES FORMED ON A DEVELOPER BEARER

(75) Inventors: Nobuyuki Taguchi, Kanagawa (JP); Katsumi Masuda, Kanagawa (JP); Takamasa Ozeki, Kanagawa (JP); Yuuki Satoh, Kanagawa (JP); Toshiki Hayashi, Kanagawa (JP); Kyohta Koetsuka, Kanagawa (JP); Toshio Kojima, Kanagawa (JP); Masayuki Ohsawa, Kanagawa (JP); Noriyuki Kamiya, Kanagawa (JP); Takumi Terasaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 115 days.

(21) Appl. No.: 13/222,588

(22) Filed: Aug. 31, 2011

(65) Prior Publication Data

US 2012/0057907 A1 Mar. 8, 2012

(30) Foreign Application Priority Data

Sep. 3, 2010 (JP) ..... 2010-198341
Sep. 3, 2010 (JP) ..... 2010-198343
Sep. 3, 2010 (JP) ..... 2010-198348

(51) Int. Cl.
*G03G 15/09* (2006.01)

(52) U.S. Cl.
USPC ..... 399/276; 399/279; 399/286; 492/28; 492/30; 492/31; 492/33; 492/34; 492/35; 492/36

(58) Field of Classification Search
USPC ..... 399/276, 286; 492/35
See application file for complete search history.

(56) References Cited

U.S. PATENT DOCUMENTS 4,561,381 A * 12/1985 Kaneko et al. ..... 399/270
5,315,061 A * 5/1994 Suzuki et al. ..... 399/239

(Continued)

FOREIGN PATENT DOCUMENTS

JP 2004-191835 7/2004
JP 2007-121964 5/2007

(Continued)

OTHER PUBLICATIONS

English machine translation of Japanese patent document JP 2011-164366 A; title: "Developing Device and Image Forming Apparatus"; by Masuda et al.*

(Continued)

*Primary Examiner* — David Gray
*Assistant Examiner* — Geoffrey Evans
(74) *Attorney, Agent, or Firm* — Oblon, Spivak, McClelland, Maier & Neustadt, L.L.P.

(57) ABSTRACT

A development device including a developer container, a developer bearer, a magnetic field generator, a developer agitator to supply the developer to the developer bearer, and a developer regulator to adjust a layer thickness of the developer carried on the developer bearer. Multiple oval recesses oblique to the axial direction of the developer bearer are formed in the outer circumferential surface of the developer bearer and arranged in a circumferential direction and the axial direction thereof. An upstream inner wall of the recess in the rotational direction of the developer bearer applies a force to the developer as the developer bearer rotates, and an angle between a long axis of the recess and the axial direction is set so that the force applied by the upstream inner wall of the recess has a component in a direction substantially identical to the developer conveyance direction of the developer agitator.

14 Claims, 16 Drawing Sheets

(56) References Cited

U.S. PATENT DOCUMENTS

| | | | | |
|---|---|---|---|---|
| 5,451,713 | A * | 9/1995 | Suzuki et al. | 399/285 |
| 5,502,552 | A * | 3/1996 | Iwata et al. | 399/222 |
| 5,674,408 | A * | 10/1997 | Suzuki et al. | 216/39 |
| 5,741,616 | A * | 4/1998 | Hirano et al. | 430/101 |
| 7,321,745 | B2 * | 1/2008 | Kawano | 399/281 |
| 7,356,294 | B2 * | 4/2008 | Ishida et al. | 399/286 |
| 7,599,650 | B2 * | 10/2009 | Katoh et al. | 399/279 |
| 7,899,374 | B2 | 3/2011 | Abe et al. | |
| 7,925,192 | B2 * | 4/2011 | Kojima et al. | 399/276 |
| 8,135,316 | B2 * | 3/2012 | Kojima et al. | 399/276 |
| 8,565,652 | B2 * | 10/2013 | Terasaka et al. | 399/276 |
| 2003/0170050 | A1 * | 9/2003 | Terai | 399/267 |
| 2007/0059047 | A1 * | 3/2007 | Kamiya et al. | 399/276 |
| 2007/0104516 | A1 * | 5/2007 | Katoh et al. | 399/276 |
| 2008/0107455 | A1 * | 5/2008 | Suzuki et al. | 399/286 |
| 2008/0170891 | A1 * | 7/2008 | Abe et al. | 399/277 |
| 2009/0060591 | A1 | 3/2009 | Kojima et al. | |
| 2010/0158578 | A1 * | 6/2010 | Kojima et al. | 399/276 |
| 2011/0129262 | A1 * | 6/2011 | Nakamoto | 399/286 |
| 2011/0135346 | A1 * | 6/2011 | Nishimura et al. | 399/286 |
| 2011/0142501 | A1 * | 6/2011 | Kamiya et al. | 399/276 |
| 2011/0194874 | A1 * | 8/2011 | Masuda et al. | 399/254 |
| 2011/0274471 | A1 * | 11/2011 | Ohsawa et al. | 399/276 |
| 2012/0057907 | A1 * | 3/2012 | Taguchi et al. | 399/276 |
| 2012/0294655 | A1 * | 11/2012 | Terasaka et al. | 399/279 |
| 2013/0058685 | A1 * | 3/2013 | Juri et al. | 399/286 |
| 2013/0071148 | A1 * | 3/2013 | Ishikura et al. | 399/286 |

FOREIGN PATENT DOCUMENTS

| | | |
|---|---|---|
| JP | 2007-183533 | 7/2007 |
| JP | 4041732 | 11/2007 |
| JP | 2009-139953 | 6/2009 |
| JP | 4669763 | 1/2011 |
| JP | 2011164366 A * | 8/2011 |

OTHER PUBLICATIONS

Extended European Search Report issued Nov. 28, 2011, in Patent Application No. 11179281.8.

* cited by examiner

C1

C2 (C3)

DEVELOPMENT DEVICE, PROCESS CARTRIDGE, AND IMAGE FORMING APPARATUS INCLUDING SAME HAVING MULTIPLE RECESSES FORMED ON A DEVELOPER BEARER

CROSS-REFERENCE TO RELATED APPLICATIONS

This patent application is based on and claims priority pursuant to 35 U.S.C. §119 to Japanese Patent Application Nos. 2010-198341 filed on Sep. 3, 2010, 2010-198343 filed on Sep. 3, 2010, and 2010-198348 filed on Sep. 3, 2010 in the Japan Patent Office, the entire disclosure of which is hereby incorporated herein by reference.

FIELD OF THE INVENTION

The present invention generally relates to a development device to developer a latent image into a toner image, a process cartridge including the same, and an electrophotographic image forming apparatus, such as a copier, a printer, a facsimile machine, or a multifunction machine having at least two of these capabilities, that includes the same.

BACKGROUND OF THE INVENTION

Generally, electrophotographic image forming apparatuses such as copiers, printers, facsimile machines, or multifunction machines including those capabilities include a development device to develop latent images formed on a latent image bearer with developer. Two-component developer consisting essentially of toner particles and magnetic carrier particles is widely used in image forming apparatuses.

Two-component development devices typically include a development roller, a developer container for containing developer supplied to the development roller, and two developer agitators provided in the developer container to agitate and transport the developer. The development roller includes a rotary development sleeve (developer bearer) and a magnetic field generator provided inside the development sleeve.

The magnetic field generator generates a magnetic force for pumping up the developer from the developer container onto the surface of the development sleeve and a magnetic force for transporting the developer to a development range where the development sleeve faces the latent image bearer. For example, to facilitate conveyance of the developer, the surface of the development sleeve is sandblasted or bead-blasted so as to form grooves or irregularities in its surface. Abrading the surface of the development sleeve by forming grooves or sandblasting can prevent or reduce slippage of the developer on the surface of the development sleeve and accumulation of the developer thereon, thus preventing a decrease in image density resulting from it.

Development sleeves having grooves on its surface can transport developer more reliably than sandblasted development sleeves because the grooves are larger than the surface irregularities by sandblasting and the durability is higher. However, the amount of the developer carried on the development sleeve is greater in portions where grooves are formed, and the image density becomes higher in portions corresponding to the grooves. Thus, the pitch of grooves causes unevenness in the image density, degrading the image quality.

Therefore, U.S. Pat. No. 7,925,192-B2 proposes forming multiple oval recesses in the surface of the development sleeve. With the recesses, the density of developer carried on the development sleeve can be as fine as that carried on blasted sleeves, and simultaneously development sleeves having the recesses are less likely to wear over time.

In such development devices, developer is circulated in the developer container by two parallel developer agitators provided therein that transport the developer in the opposite direction. The developer is thus agitated to uniformize charge amount of toner carried on the development sleeve and the concentration of toner in the developer.

FIGS. 34A illustrates a configuration of a known development device.

The development device shown in FIG. 34A includes a development roller 200 to transport developer G to a development range facing an image bearer 201, developer containing compartments 204*a* and 204*b*, and developer agitators 205*a* and 205*b* to transport the developer G in opposite directions. The development roller 200 includes a cylindrical development sleeve 202 and a magnet roller 203 provided inside the development sleeve 202 to generate a magnetic field. The developer G is pumped up to the surface of the development sleeve 202, attracted by the magnetic force exerted by the magnet roller 203. After a doctor blade 206 adjusts the layer thickness of the developer G carried on the development sleeve 202, the developer G is transported to the development range, where toner in the developer G adheres to the electrostatic latent image on the image bearer 201, developing it into a toner image.

In response to demands for high-quality images and energy saving, small-diameter toner having a lower melting point is preferred. Small-diameter toner having a lower melting point is less durable against stress, and changes in the properties thereof can affect image development.

In the above-described development device in which the developer is circulated, properties of the developer can differ between an upstream portion and a downstream portion in the direction in which the developer is transported (hereinafter "developer conveyance direction") since the developer in the downstream portion has received stress repeatedly from the doctor blade and in the development range. More specifically, the developer in the upstream portion in the developer conveyance direction has a higher developability because fresh toner is supplied thereto. By contrast, toner in the developer in the downstream portion in the developer conveyance direction is degraded by the stress from the doctor blade and in the development range and has a reduced developability. The difference in the developability in the longitudinal direction of the image formation range appears as unevenness in image density.

To address the above-described problem, unidirectional circulation methods in which developer once used is not reused, and improvement of conveyance ability of developer agitators are proposed. However, in unidirectional circulation type development devices, the velocity at which the developer is transported should be increased, and thus enhanced transport ability (i.e., rotational frequency) is required, resulting in increases in size of the development device as well as increases in the stress on the developer.

In addition, in axial end portions of the development roller, the developer that has been used in image development (toner concentration is lower) tends to fail to leave the development sleeve and is again supplied to the development range, which is described in further detail below.

The magnet roller 203 shown in FIG. 33A has multiple fixed magnetic poles, for example, a development pole S1, a developer conveyance pole N1, an upstream release pole S2, an attraction pole or downstream release pole S3, and a developer conveyance pole N2. As the development sleeve 202 rotates, the developer G carried on the development sleeve 202 passes by the magnetic poles S3, N2, S1, N1, and S2 sequentially, and the developer G is separated from the development sleeve 202 in a release portion upstream from the attraction pole S3 in the direction in which the development sleeve 202 rotates.

After passing through the development range, the developer G falls in the developer containing compartment 204*a* due to the repulsive force between the magnetic poles S2 and S3. When another south pole P is provided between the magnetic poles S2 and S3, the repulsive force of the magnetic pole P can contribute to the separation of developer from the development sleeve 202. The developer G having a reduced toner concentration is mixed with developer having a higher toner concentration, transported from the developer containing compartment 204*b*, in the developer containing compartment 204*a*. Subsequently, the mixed developer is pumped up to the development sleeve 202 by the attraction pole S3.

Although the developer G within the image formation range moves as described above, in axial end portions of the development roller 200, the developer G separated from the development sleeve 202 by the upstream release pole S2 tends to move through outer portions where the magnetic force of the magnet roller 203 is not present toward the attraction pole (downstream release pole) S3. This is a phenomenon called "carry-over of developer".

If the portion where carry-over of developer occurs contribute to image development, the image density of the resultant image decreases in the direction in which the sheet is transported because the developer is not replenished with toner from the developer container.

In this known development device, carry-over of developer is deemed inevitable, and, as shown in FIG. 34B, the development roller 200 is expanded in the longitudinal direction so that carry-over of developer occurs in outer portions Al outside the image formation range. Thus, the development device increases in size by the corresponding amount. As another approach, the shaft of the development roller may be made of a nonmagnetic material. However, the cost is increased when stainless steel is used, and strength is not sufficient when aluminum is used.

BRIEF SUMMARY OF THE INVENTION

In view of the foregoing, one illustrative embodiment of the present invention provides a development device to develop a latent image formed on a latent image bearer with two-component developer. The development device includes a casing, a developer container housed in the casing for containing the developer, a hollow, cylindrical developer bearer positioned facing the latent image bearer in a development range, a magnetic field generator disposed inside the developer bearer, a developer agitator provided in the developer container, and a developer regulator positioned upstream from the development range in a rotational direction of the developer bearer across a predetermined gap from an outer circumferential surface of the developer bearer to adjust a layer thickness of the developer carried on the developer bearer. The developer bearer transports by rotation the developer to the development range where the developer forms a magnetic brush and slides on the latent image bearer. The developer agitator supplies the developer contained in the developer container to the developer bearer while transporting the developer in an axial direction of the developer bearer.

Multiple oval recesses oblique to the axial direction of the developer bearer are formed in the outer circumferential surface of the developer bearer and arranged in a circumferential direction of the developer bearer and the axial direction of the developer bearer. An upstream inner wall of each of the multiple recesses on an upstream side in the rotational direction of the developer bearer applies a force to the developer as the developer bearer rotates, and an angle between a long axis of each of the multiple recesses and the axial direction of the developer bearer is set so that the force applied by the upstream inner wall of each recess has a component in a direction substantially identical to the direction in which the developer agitator transports the developer.

Another embodiment provides a process cartridge removably installable in an image forming apparatus that includes the development device described above. The development device and the latent image bearer are housed in a common casing.

Another embodiment provides an image forming apparatus that includes the latent image bearer and the development device described above.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
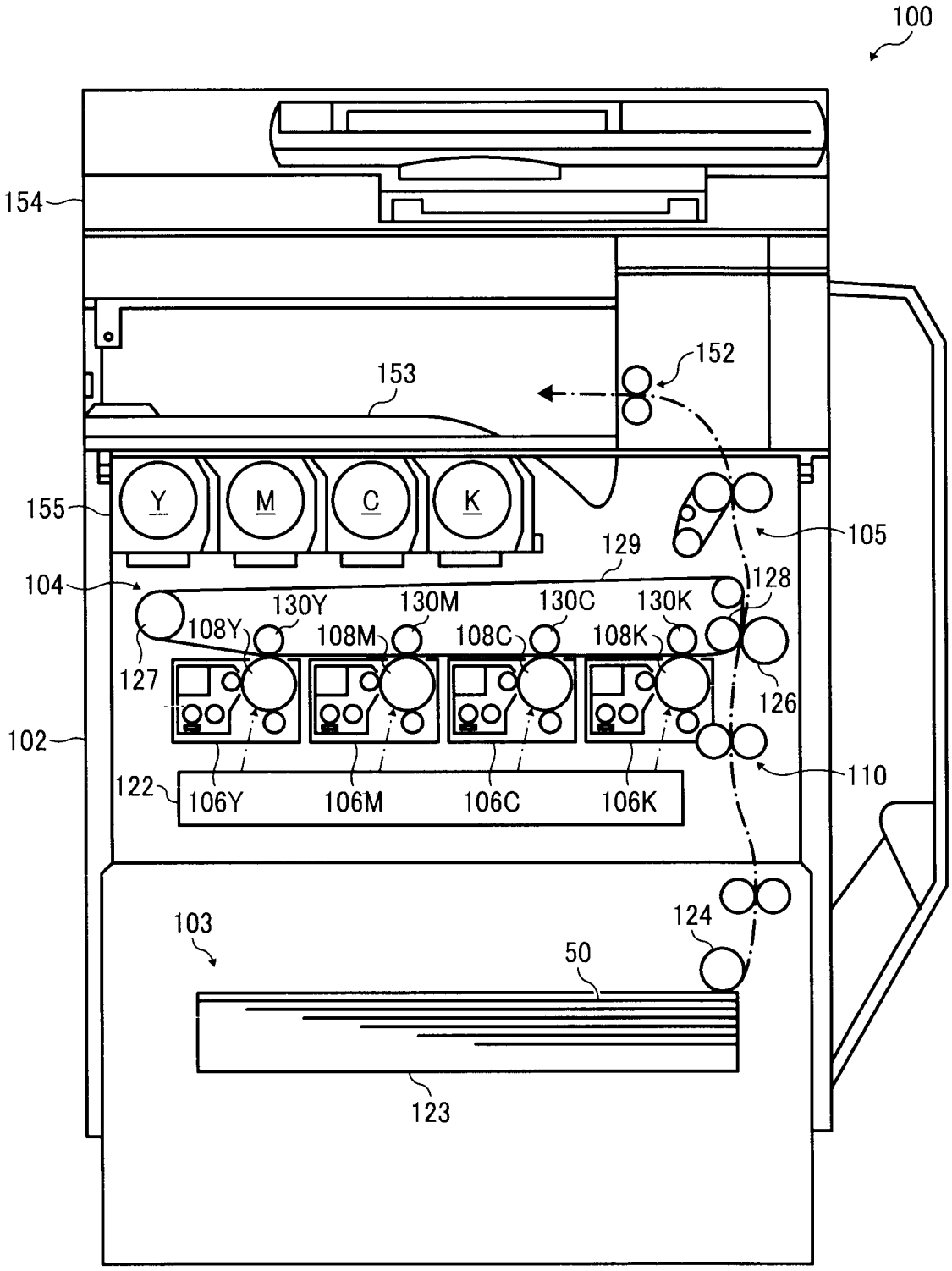
FIG. 1 is a schematic view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an illustrative embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

A first embodiment is described below with reference to FIGS. 1 through 8.

Initially, a configuration of an image forming apparatus according to the present embodiment, which may be a multicolor copier, for example, is described below.

Referring to FIG. 1, an image forming apparatus 100 is a tandem image forming apparatus that uses an intermediate transfer belt 129 and forms a multicolor image on a recording sheet 50 by superimposing yellow (Y), magenta (M), cyan (C), and black (K) single-color images one on another. It is to be noted that that the suffixes Y, M, C, and K attached to the end of each reference numeral indicate only that components indicated thereby are used for forming yellow, magenta, cyan, and black images, respectively, and hereinafter may be omitted when color discrimination is not necessary.

Referring to FIG. 1, the image forming apparatus 100 includes a main body 102, a sheet feeder 103, a pair of registration rollers 110, an intermediate transfer unit 104, a secondary-transfer roller 126, a fixing device 105, a laser writing unit 122, and multiple process cartridges 106Y, 106M, 106C, and 106K.

The sheet feeder 103 includes a sheet cassette 123 for containing multiple recording sheets 50 and a feed roller 124. The sheet cassette 123 can be pulled out from and retracted into the main body 102. The feed roller 124 is pressed against the recording sheet on the top in the sheet cassette 123. The feed roller 124 and a sheet separator together separate the top recording sheet 50 from the rest and feed it to the registration rollers 110.

The registration rollers 110 are positioned in a route through which the recording sheet 50 is transported from the sheet feeder 103 to a secondary-transfer position. The registration rollers 110 stop the sheet by clamping it in the nip therebetween, and then forward the sheet timed to coincide with arrival of an image formed on the intermediate transfer belt 129.

The intermediate transfer unit 104 is provided above the process cartridges 106Y, 106M, 106C, and 106K. The intermediate transfer unit 104 includes a driving roller 128, a driven roller 127, the intermediate transfer belt 129, and primary-transfer rollers 130Y, 130M, 130C, and 130K. The driving roller 128 is positioned facing the secondary-transfer roller 126 via the intermediate transfer belt 129 and driven by a driving source such as a motor. The driven roller 127 is rotatably supported by the main body 102. The intermediate transfer belt 129 is an endless belt and stretched around the driving roller 128 and the driven roller 127. As the driving roller 128 rotates, the intermediate transfer belt 129 rotates counterclockwise in FIG. 1.

Each primary-transfer roller 130 is positioned facing via the intermediate transfer belt 129 a photoreceptor drum 108 included in the corresponding process cartridge 106.

In the intermediate transfer unit 104, the primary-transfer rollers 130 transfer the single-color toner images formed by the respective process cartridges 106 and superimpose the images one on another on the intermediate transfer belt 129, forming a multicolor toner image. Then, the intermediate transfer belt 129 transports the multicolor toner image to the secondary-transfer position, where the secondary-transfer roller 126 transfers the image onto the recording sheet 50.

The transfer roller 126 forwards the recording sheet 50 carrying the toner image to the fixing device 105.

The fixing device 105 fixes the toner image on the recording sheet 50 with heat and pressure, after which the recording sheet 50 is discharged by a pair of discharge rollers 152 to a discharge tray 153.

In FIG. 1, reference numeral 154 denotes an image reading unit.

The laser writing unit 122 is attached to the bottom of the process cartridges 106. The laser writing unit 122 directs laser beams onto the surfaces of the photoreceptor drums 108 in the respective process cartridges 106, thus forming electrostatic latent images thereon after charge rollers 109 charge the surfaces of the photoreceptor drums 108 uniformly.

The process cartridges 106 are positioned between the intermediate transfer unit 104 and the laser writing unit 122. The process cartridges 106 are arranged in parallel to each other in the direction in which the intermediate transfer belt 129 rotates.

Figure 2:
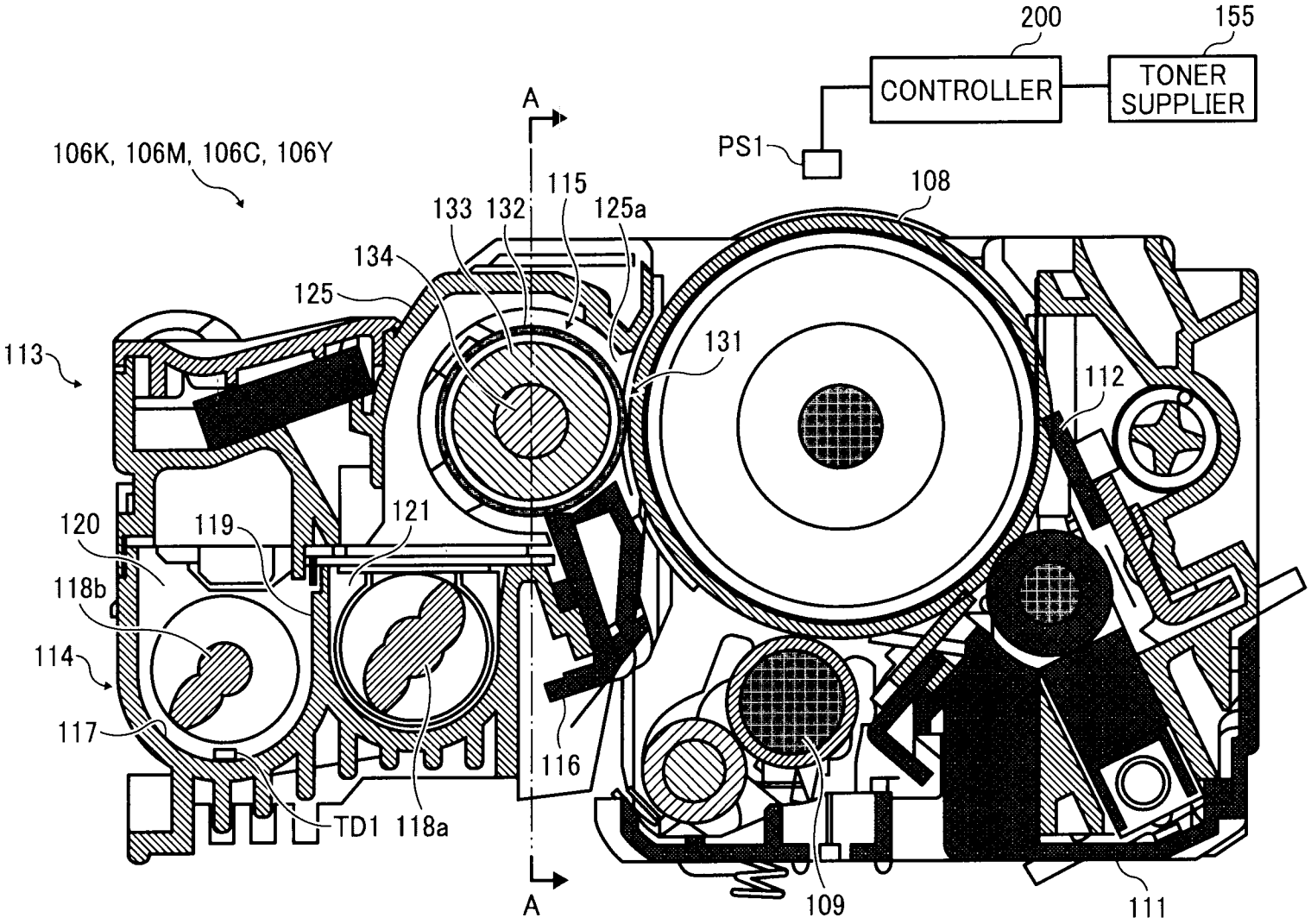
FIG. 2 is a cross-sectional diagram that schematically illustrates a configuration of a process cartridge.

In the configuration shown in FIG. 2, each process cartridge 106 includes a cartridge casing 111, the charge roller 109 serving as a charge member, the photoreceptor drum 108, a cleaning blade 112 serving as a cleaning member, and a development device 113.

The charge roller 109 charges the surface of the photoreceptor drum 108 uniformly. The photoreceptor drum 108 is positioned across a gap from a development roller 115 of the development device 113.

The cleaning blade 112 removes any toner remaining on the surface of the photoreceptor drum 108 after image transfer.

As shown in FIG. 2, the development device 113 includes a casing 125, a developer supply unit 114, the development roller 115 serving as a developer bearer, and a doctor blade 116 serving as a developer regulator.

The developer supply unit 114 includes a developer container 117, a supply screw 118*a* serving as a developer agitator, and a conveyance screw 118*b*. The supply screw 118*a* and the conveyance screw 118*b* are hereinafter also collectively referred to as agitation screws 118. For example, the developer container 117 is shaped like a box and has an axial length (i.e., a length in its longitudinal direction) equal or similar to an axial length of the photoreceptor drum 108. Additionally, a partition 119 extending in the longitudinal direction of the developer container 117 is provided inside the developer container 117. The partition 119 divides the developer container 117 into a first compartment 120 and a second compartment 121 that communicate with each other in both end portions in the longitudinal direction of the development roller 115. Thus, the developer can circulate inside the developer container 117.

The developer used in the present embodiment is two-component developer consisting essentially of toner particles and magnetic particles (also "magnetic powder"). Fresh toner is supplied as required by the toner supplier 155 to one of axial end portions of the first compartment 120, which is positioned farther from the development roller 115 than the first compartment 121 is.

For example, toner particles are spherical fine particles produced through an emulsion polymerization method or a suspension polymerization method. It is to be noted that, alternatively, toner may be produced by pulverization. For example, toner can be produced by smashing synthetic resin blocks in which various colorants and pigments are mixed or dispersed. The toner particles have a mean particle diameter of within a range from about 3 μm to 7 μm.

The magnetic carrier is contained in both the first and second compartments 120 and 121. The magnetic carrier particles have a mean particle diameter of within a range from about 20 μm to 50 μm.

The agitation screws 118 are provided in the first and second compartments 120 and 121, respectively. The long axes of the agitation screws 118 parallel the longitudinal direction of the developer container 117, the development roller 115, and the photoreceptor drum 108. Each agitation screw 118 mixes the toner particles with the magnetic carrier particles and transports the developer in the axial direction while rotating.

In the configuration shown in the figures, the conveyance screw 118*b* in the first compartment 120 transports the developer from the axial end portion to which the toner is supplied to the other axial end portion. The supply screw 118*a* in the second compartment 121 transports the developer in the direction opposite the direction in which the developer is transported (hereinafter "developer conveyance direction") in the first compartment 120.

In the above-described configuration, in the developer supply unit 114, while being mixed together, the toner supplied to the end portion of the first compartment 120 is mixed with the magnetic carrier and transported to a downstream end portion in the developer conveyance direction in the first compartment 120, from which the developer is sent out to an upstream end portion of the second compartment 121 in the developer conveyance direction therein. The toner and the magnetic carrier are further agitated in the second compartment 121 and then supplied to the circumferential surface of the development roller 115 while being transported in the axial direction.

The casing 125 is box-shaped and is attached to the developer container 117 of the developer supply unit 114. The casing 125 and the developer container 117 together cover the development roller 115 and the like. Additionally, an opening 125*a* is provided in a portion of the casing 125 facing the photoreceptor drum 108.

The development roller 115 is columnar and is positioned between the second compartment 121 and the photoreceptor drum 108, adjacent to the opening 125*a*. The development roller 115 parallels both the photoreceptor drum 108 and the developer container 117. As described above, the development roller 115 is positioned across the predetermined gap from the photoreceptor drum 108.

The gap between the development roller 115 and the photoreceptor drum 108 serves as a development range 131 where the toner in the developer adheres to the photoreceptor drum 108, thus developing the electrostatic latent image formed thereon into a toner image. The development roller 115 faces the photoreceptor drum 108 in the development range 131.

Figure 3A:
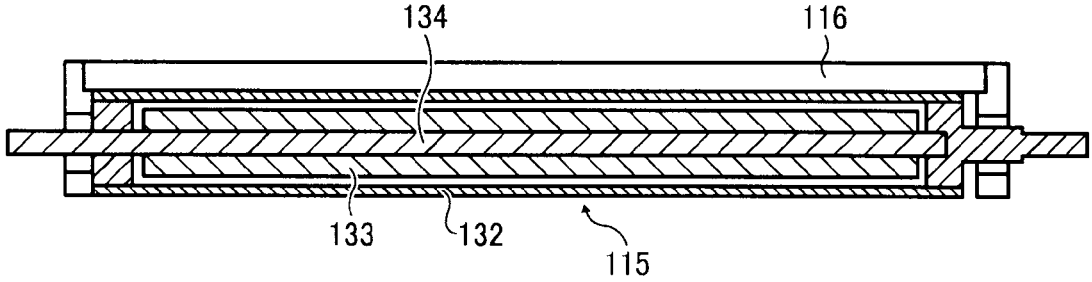
FIG. 3A is a cross-sectional view of a development roller along line A-A shown in FIG. 2.
Figure 3B:
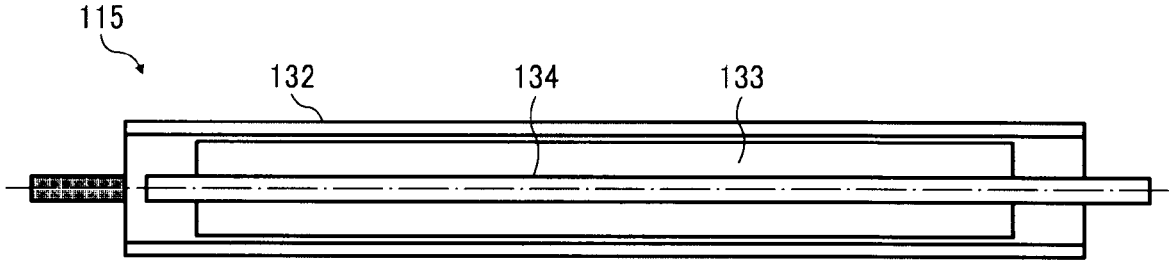
FIG. 3B is a cross-sectional view illustrating another configuration of the development roller.
Figure 4:
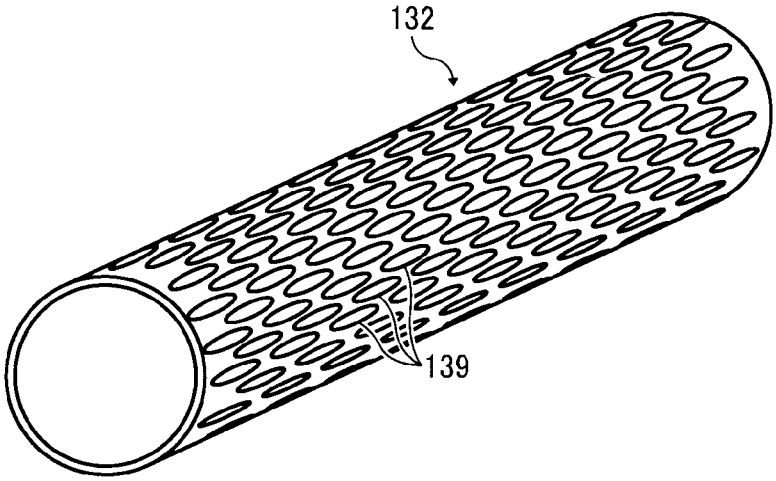
FIG. 4 is a perspective view of a development sleeve.

As shown in FIGS. 2 and 3, the development roller 115 includes a metal core 134, a cylindrical magnet roller 133 (also "magnet body"), and a hollow, cylindrical development sleeve 132. The metal core 134 is positioned with its longitudinal direction in parallel to that of the photoreceptor drum 108 and is attached to the casing 125. The metal core 134 does not rotate, that is, its position is fixed relative to the casing 125. It is to be noted that the term "cylindrical" used in this specification is not limited to round columns but also includes polygonal prisms.

The magnet roller 133 is formed of a magnetic material and cylindrical. Multiple stationary magnetic poles are formed in the magnet roller 133. The magnet roller 133 is provided outside an outer circumferential surface of the metal core 134. The magnet roller 133 does not rotate, that is, its position is fixed relative to the metal core 134 or the casing 125.

For example, the fixed magnetic poles of the magnet roller 133 are formed with multiple magnets shaped like long bars and fixed to the magnet roller 133. The magnets extend in the longitudinal direction of the magnet roller 133, that is, the longitudinal direction of the development roller 115, over the entire longitudinal length of the magnet roller 133, for example. The magnet roller 133 is contained inside the development sleeve 132.

One of the multiple fixed magnetic poles faces the supply screw 118*a* provided in the second compartment 121 and serves as an attraction pole. More specifically, the attraction pole generates an attractive magnetic force on the development sleeve 132, that is, the outer surface of the development roller 115 for attracting the developer contained in the second compartment 121 of the developer container 117 to the surface of the development sleeve 132. Thus, the developer can be adsorbed to the outer circumferential surface of the development sleeve 132.

Another magnetic pole faces the photoreceptor drum 108 and serves as a development pole for generating a magnetic force on the outer surface of the development sleeve 132 in the development range. Thus, a magnetic field for image development is formed between the development sleeve 132 and the photoreceptor drum 108. The magnetic field formed by the development pole causes the developer to form magnetic brushes, thereby transferring the toner particles in the developer from the surface of the development sleeve 132 to the photoreceptor drum 108.

One more fixed magnetic pole may be present between the attraction pole and the development pole. The magnetic pole positioned between the attraction pole and the development pole serves as a developer conveyance pole for generating a magnetic force on the surface of the development sleeve 132 (development roller 115) for transporting the developer (developer before development) toward the photoreceptor drum 108 and for transporting the developer (developer after development) collected from the photoreceptor drum 108 to the developer container 117.

More specifically, after attracting the developer to the outer surface of the development sleeve 132, the above-described magnetic pole causes the magnetic carrier particles contained in the developer to stand on end on the development sleeve 132 along the lines of magnetic force generated by the fixed magnetic pole.

The toner particles in the developer are adsorbed to the magnetic carrier particles standing on end thereon. Thus, the development sleeve 132 adsorbs the developer to the outer surface thereof with the magnetic force exerted by the magnet roller 133.

The development sleeve 132 is supported by the casing 125, for example, rotatably about the axis of rotation so that its inner circumferential surface faces the multiple fixed magnetic poles sequentially. The development sleeve 132 is formed of nonmagnetic material such as aluminum alloy, brass, stainless steel (SUS), or electroconductive resin. The surface of the development sleeve 132 is roughened by a surface processing device. More specifically, the surface of rotating development sleeve 132 is cut with an end mill, thereby forming multiple recesses 139 (shown in FIG. 4) in the surface of the development sleeve 132.

As the material of the development sleeve 132, aluminum alloy excels in its lightness and easiness in processing. A6063, A5056, and A3003 are preferable as aluminum alloy. When stainless steel is used, SUS303, SUS304, and SUS316 are preferable. In the configuration shown in the figures, the development sleeve 132 is formed of aluminum alloy.

In the present embodiment, the development sleeve 132 has an external diameter of about 18 mm. The axial length of the development sleeve 132 is preferably within a range of from about 300 mm to 350 mm when the maximum sheet size that the image forming apparatus 101 accommodates is A3 size.

As shown in FIGS. 4, 5, 6A, and 7, the multiple recesses 139 formed in the outer surface of the development sleeve 132 are oval or shaped like long oval in the plan view.

In the configuration shown in those figures, the multiple recesses 139 formed in the surface of the development sleeve 132 are regularly arranged in the circumferential direction as well as the longitudinal direction of the development sleeve 132 not to overlap each other. It is to be noted that "regularly arranged" used in this specification means that the recesses 139 are arranged so that the distance between two adjacent recesses 139 is identical in the circumferential direction as well as in the longitudinal direction of the development sleeve 132. In other words, the recesses 139 are arranged at regular intervals in the circumferential direction and in the longitudinal direction of the development sleeve 132.

Additionally, each recess 139 is positioned with its long axis along the longitudinal direction of the development sleeve 132. In the configuration shown in FIGS. 4 and 5, the long axis of each recess 139 is slightly oblique. The long axis of each recess 139 may be substantially in parallel to the longitudinal direction of the development sleeve 132.

Figure 5:
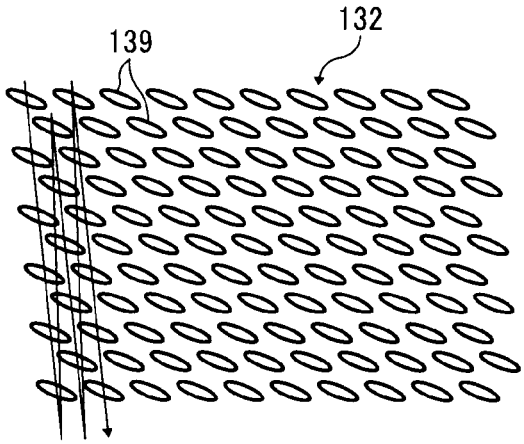
FIG. 5 is a plan view illustrates arrangement of recesses formed in the surface of the development sleeve.
Figure 6A:
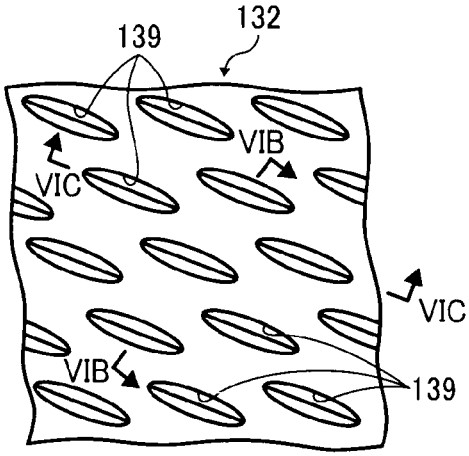
FIG. 6A is a plan view illustrating the recesses.
Figure 7:
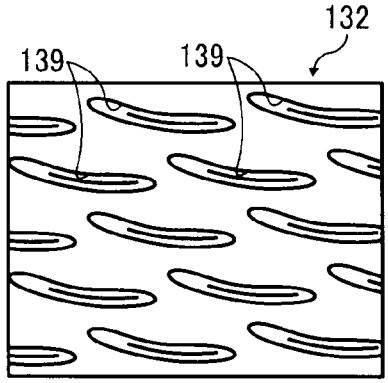
FIG. 7 is a plan view illustrating curved recesses formed by cutting processing.

As shown in FIGS. 5, 6A, and 7, two adjacent recesses 139 in the circumferential direction of the development sleeve 132 are shifted from each other in the longitudinal direction by about half the longitudinal length of the recess 139 or half a length of each recess 139 in the longitudinal direction of the development sleeve 132. Moreover, the recesses 139 are aligned with a spiral line shown in FIG. 5 since the recesses 139 are formed by the surface processing device in the surface of the development sleeve 132.

Figure 6B:
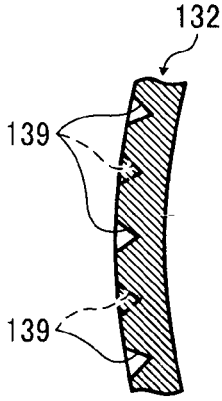
FIG. 6B is a cross-sectional view of the development sleeve in its circumferential direction, along line VIB shown in FIG. 6A.
Figure 6C:
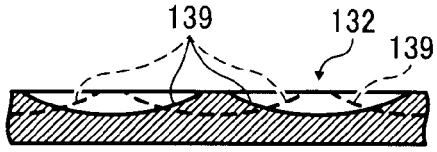
FIG. 6C is a cross-sectional view of the development sleeve in its longitudinal direction, along line VIC shown in FIG. 6A.

Additionally, the recesses 139 are V-shaped in its width direction or the circumferential direction of the development sleeve 132 as shown in the cross-sectional view shown in FIG. 6B and are arc-shaped in its longitudinal direction or the longitudinal direction of the development sleeve 132 as shown in the cross-sectional view shown in FIG. 6C. Since the recesses 139 are formed by the surface processing device in the surface of the development sleeve 132, the recesses 139 are slightly arched in the longitudinal direction in the plan view as shown in FIG. 7.

It is to be noted that the term "oval" used in this specification includes both shapes that are straight in the longitudinal direction and those curved in the longitudinal direction as long as the longitudinal length is longer than the width and the outline is curved.

In the present embodiment, for example, the recesses 139 have a longitudinal length of from 1.0 mm to 2.3 mm (1.0 mm and 2.3 mm included), a width of from 0.3 mm to 0.7 mm (0.3 mm and 0.7 mm included), and a depth of from 0.05 mm to 0.15 mm (0.05 mm and 0.15 mm included).

About 50 to 250 recesses 139 are formed in each 100 $mm^2$ of the surface of the development roller 115. In other words, the cubic capacity (dimension) of the multiple recesses 139 in total is from 0.5 $mm^3$ to 7.0 $mm^3$ per an area of 100 $mm^2$ of the surface of the development roller 115.

In addition, the number of the recesses 139 is about 1.0 to 3.0 per 1 mm in the circumferential direction of the photoreceptor drum 108 that rotates together with the development roller 115. It is to be noted that the longitudinal direction of the development sleeve 132 is in the lateral direction in FIGS. 5, 6A, and 7.

Although, typically, the developer conveyance ability of the development sleeve 132 increases as the depth of the recesses 139 increases, the amount of developer carried thereon is more likely to become uneven cyclically due to the pitch of the recesses 139 as the depth of the recesses 139 increases, similarly to grooved development sleeves. Thus, density unevenness is caused by the pitch of the recesses 139.

By contrast, although unevenness in the amount of developer is alleviated as the depth of the recesses 139 decreases, the developer conveyance ability of the development sleeve 132 also decreases. In particular, currently, the pitch of the recesses can make the image density uneven more frequently since image reproducibility is improved owing to progress in image formation technology, such as introduction of smaller toner particles and magnetic carrier particles and close development technologies.

Therefore, in the development sleeve 132 according to the present embodiment, while the depth of the recesses 139 is relatively small, the distribution density of the recesses 139 is increased to balance the developer conveyance ability and prevention of unevenness in the image density caused by the pitch of the recesses 139, which is described in further detail later.

Referring again to FIG. 2, the doctor blade 116 is provided in an end portion of the development device 132 on the side of the photoreceptor drum 108. The doctor blade 116 is attached to the casing 125 at a position across a gap from the surface of the development sleeve 132.

The doctor blade 116 removes the developer from the development sleeve 132 when the amount is excessive, that is, the thickness exceeds a predetermined thickness, and returns the excessive developer to the developer container 117, thereby adjusting the amount of developer conveyed to the development range 131.

In the development device 113, the toner and the magnetic carrier are agitated sufficiently in the developer supply unit 114, and the developer is attracted to the surface of the development sleeve 132 by the magnetic force exerted by the fixed magnetic poles. The development sleeve 132 rotates and conveys the developer attracted to the surface thereof by the multiple magnetic poles to the development range 131. Then, the doctor blade 116 adjusts the amount of the developer carried on the development sleeve 132, and then the developer is attracted to the photoreceptor drum 108. Thus, the electrostatic latent image on the photoreceptor drum 108 is developed into a toner image.

Further, the development device 113 separates the developer used in image development from the development sleeve 132 and returns it to the developer container 117. The used developer is agitated with the developer contained in the second compartment 121 of the developer container 117 and is again used to develop the latent image formed on the photoreceptor drum 108.

It is to be noted that, when a toner concentration detector TD1 (shown in FIG. 2) detects that the concentration of toner in the developer supplied from the developer supply unit 114 to the photoreceptor drum 108 has decreased, a controller 200 of the image forming apparatus causes the toner supplier 155 to supply fresh toner to the development device 113. It is to be noted that the image forming apparatus 100 may further includes a photosensor PS1 (shown in FIG. 2) for detecting a toner pattern formed on the photoreceptor drum 108 for detecting the developability of the development device 113.

Differently from blasted (e.g., sandblasted) development sleeves, the development sleeve 132 having the recesses 139 on the outer surface thereof does not include projections on the surface, which has advantages. For example, the recesses 139 are less likely to wear over time, and accordingly the decrease in the developer conveyance ability can be reduced.

Additionally, the developer can accumulate in the recesses 139 that are positioned regularly not to overlap each other in the surface of the development sleeve 132. That is, the portions where the developer accumulates are arranged regularly, which can prevent or reduce unevenness in the image density. Further, the amount of developer carried on the development sleeve 132 can be increased for maintaining high image quality in high speed image forming apparatuses by adjusting the capacity of each recess 139 or the quantity of the recesses 139.

Moreover, the regular arrangement of the recesses 139 can attain the following advantages. The processing conditions can be adjusted easily for balancing expansion of useful life of the development sleeve 132 and increasing the amount of developer carried thereon. The recesses 139 can be formed reliably under preset conditions, and processing can be easier.

Since two of the multiple recesses 139 adjacent to each other in the circumferential direction of the development sleeve 132 are shifted from each other in the longitudinal direction thereof, the recesses 139 can be distributed entirely and uniformly. That is, there are no portions where no recess 139 is present or portions where the recesses 139 are denser than other portions.

Therefore, unevenness in the amount of developer attracted to the surface of the development sleeve 132 can be prevented or reduced, thus preventing or reducing unevenness in the image density.

The recesses 139 are configured to give a force to transport the developer on the surface of the development sleeve 132.

Figure 8:
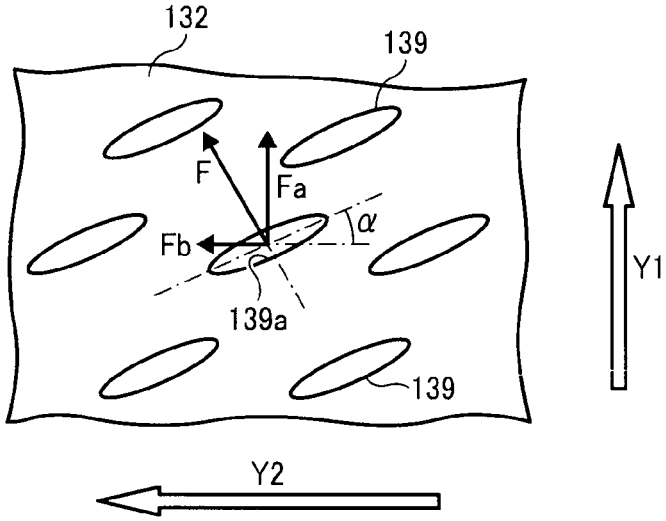
FIG. 8 is a plan view illustrating the relation between a component of force for transporting the developer and the inclination of the long axis of the recess to the longitudinal direction of the development sleeve.

More specifically, as shown in FIG. 8, the long axis of the recess 139 is oblique, that is, at an angle $\alpha$, relative to the longitudinal direction (axial direction) of the development sleeve 132 indicated by arrow Y2.

As the development sleeve 132 rotates, the developer receives a force in the direction indicated by arrow F (hereinafter "force F") from an edge face 139*a* of the recess 139 on the upstream side in the direction of rotation of the development roller 115 indicated by arrow Y1 shown in FIG. 8 (hereinafter "rotational direction Y1"). Thus, the developer is transported on the surface of the development sleeve 132. A component Fb of the force F in the axial direction of the development sleeve 132 is identical or similar to the developer conveyance direction (hereinafter "developer conveyance direction Y2").

The recesses 139 shaped as described above can transport the developer to the development range (of the development sleeve 132) and in the axial direction of the development sleeve 132 simultaneously. In other words, the transport force in the axial direction (developer conveyance direction Y2) can be secured while maintaining the transport force in the rotational direction Y1 of the development roller 115.

Giving the surface of the development sleeve 132 the force to transport the developer in its axial direction can reduce the frequency of the developer passing by the doctor blade 116 or being used in the development range. Thus, the stress on the developer can be reduced. In addition, giving the surface of the development sleeve 132 the force to transport the developer in its axial direction can reduce the rotational frequency of the agitation screw, reducing the energy. When the rotational frequency is kept, unevenness in image density can be reduced.

In the present embodiment, the angle (inclination) a of the recesses 139 to the axial direction of the development sleeve 132 is within a range of from 10° to 45°. When the angle α is 10° or smaller, the above-described transport force is insufficient. When the angle α is 45° or greater, the force to transport the developer to the development range 131 is weaker, resulting in substandard images in which the image density is uneven or the like.

A second embodiment is described below with reference to FIG. 9.

It is to be noted that components similar to those of the above-described embodiment are given identical or similar reference characters, and thus descriptions thereof omitted.

Figure 9:
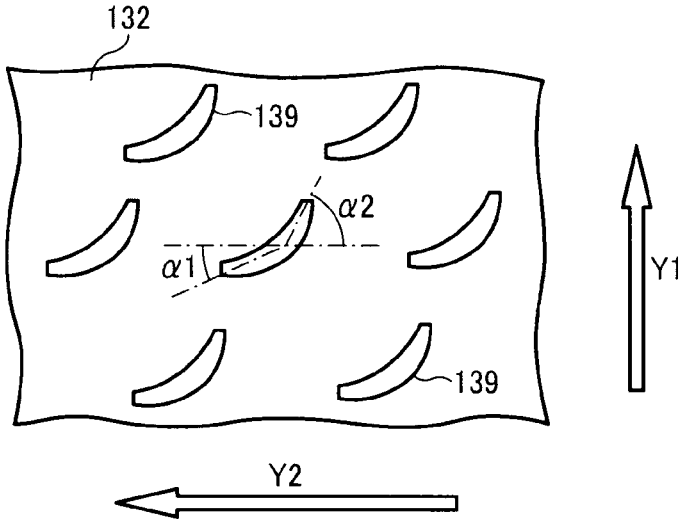
FIG. 9 is a plan view of the surface of the development sleeve in which the angle between the long axis of the recess and the longitudinal direction of the development sleeve is different between the upstream side and the downstream side in the longitudinal direction of the development sleeve.

As shown in FIG. 9, in the present embodiment, the long axis of each recess 139 is curved so that its center portion is recessed upstream in the rotational direction Y1 of the development sleeve 132, that is, the center portion projects in the direction opposite the rotational direction Y1 of the development sleeve 132.

The recess 139 thus curved in the rotational direction Y1 of the development sleeve 132 can scoop the developer, and the conveyance of the developer can be improved.

More specifically, the recess 139 is curved so that the angle between the long axis thereof and the axial direction of the development sleeve 132 (developer conveyance direction Y2) is greater on the upstream side in the developer conveyance direction Y2 than on the downstream side thereof.

That is, when the angle between the long axis thereof and the axial direction of the development sleeve 132 on the downstream side (on the left in FIG. 9) and that on the upstream side (on the right in FIG. 9) are α1 and α2, respectively, α1<α2. With this configuration, the recess 139 can scoop the developer, improving the conveyance of the developer.

Figure 10:
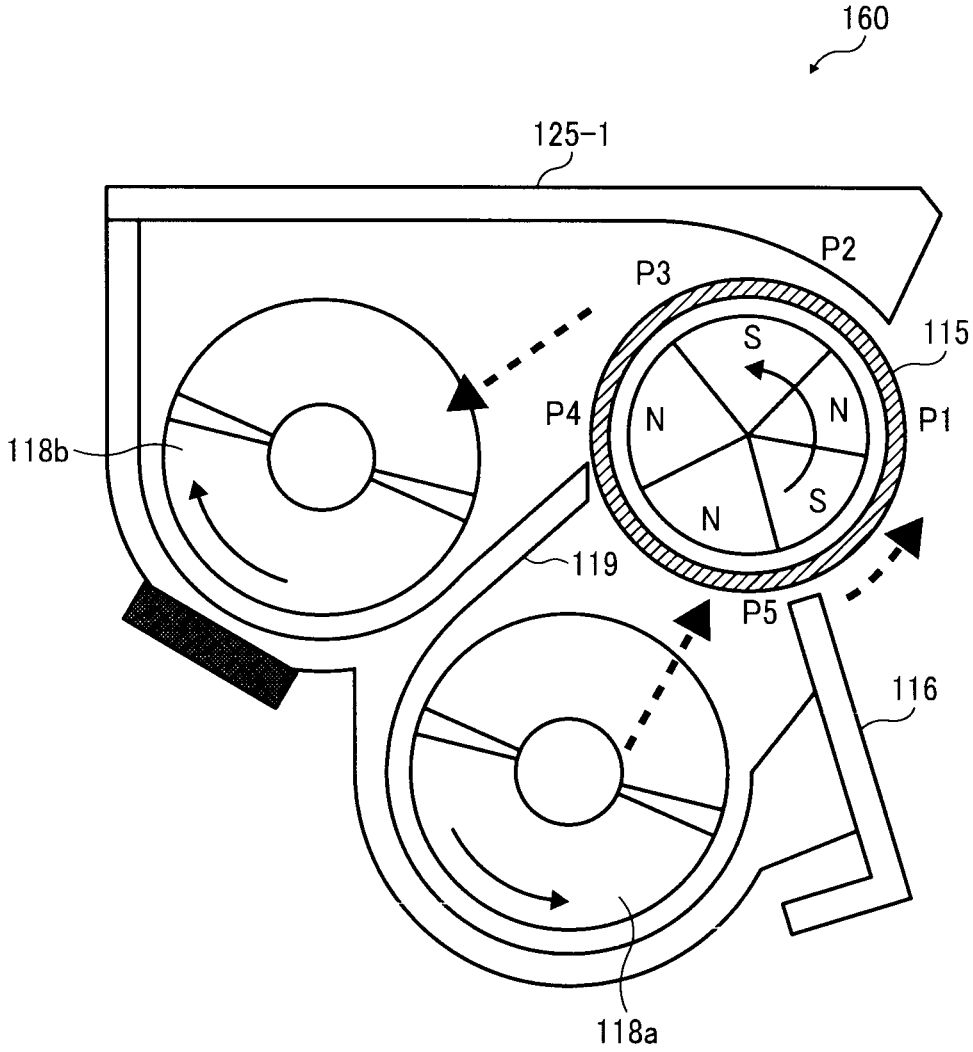
FIG. 10 illustrates a variation of the development device.

FIG. 10 illustrates a variation of the development device.

Referring to FIG. 10, a development device 160 includes a casing 125-1 that is different from that in the configuration shown in FIG. 2. In FIG. 10, reference characters 118*a* and 118*b* represent a supply screws on the side closer to a development roller 115 and a collecting screw on the side away from the development roller 115. The casing 125-1 is shaped to bring the distal conveyance screw 118*b* closer to the development roller 115 compared with the configuration shown in FIG. 2.

Figure 11A:
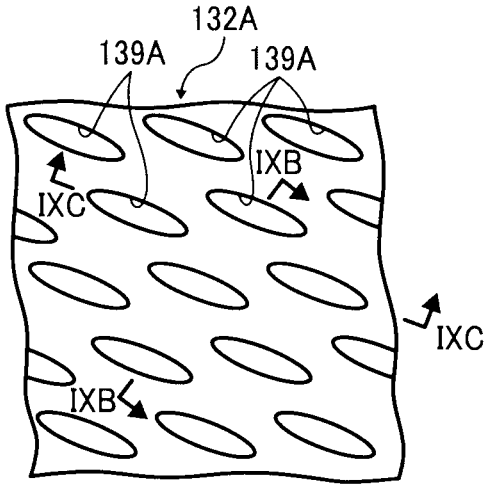
FIG. 11A is a plan view illustrating the recesses according to the variation.
Figure 11B:
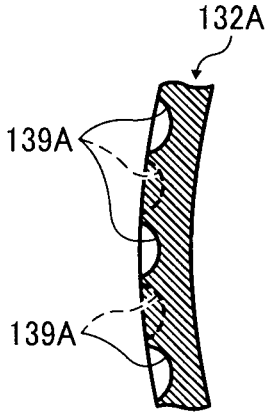
FIG. 11B is a cross-sectional view of the development sleeve in its circumferential direction, along line IXB shown in FIG. 11A.
Figure 11C:
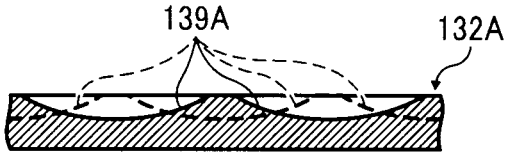
FIG. 11C is a cross-sectional view of the development sleeve in its longitudinal direction, along line IXC shown in FIG. 11A.

FIGS. 11A, 11B, and 11C illustrate multiple recesses 139A formed in the surface of a development sleeve 132A in the present variation and correspond to FIGS. 6A, 6B, and 6C, respectively.

The supply screw 118*a* supplies developer to the development roller 115 while transporting the developer in the longitudinal direction (axial direction) thereof. The developer that has left the development device 115 is received by the conveyance screw 118*b* and is mixed with supplied toner. Then, the agitated developer is transported to the supply screw 118*a*. With this configuration, the developer is circulated unidirectionally as indicated by arrows shown in FIG. 10.

Typically, in unidirectional circulation type development devices, the velocity at which the developer is transported should be increased, and thus enhanced transport ability (i.e., rotational frequency) is required, resulting in increases in size of the drive device as well as increases in the stress on the developer.

In the development device 160 according to the variation, however, recesses 139A formed in the surface of the development sleeve 132A can facilitate conveyance of the developer in the developer conveyance compartment to which the developer is collected, and the rotational frequency of the conveyance screw 118*b* provided therein can be reduced. That is, the required increase in the developer conveyance velocity can be reduced.

Although, in the above-described embodiment, the recesses 139 are V-shaped in cross section in the circumferential direction of the development sleeve 132 as shown in FIG. 6B, the recesses 139 formed in the development sleeve 132 may have an arc shape in cross section as shown in FIGS. 11B and 11C. In the configuration shown in FIGS. 11A through 11C, the multiple recesses 139A formed in the surface of the development sleeve 132A have an arc shape in cross section in the circumferential direction as well as the longitudinal direction of the development sleeve 132A.

Figure 12:
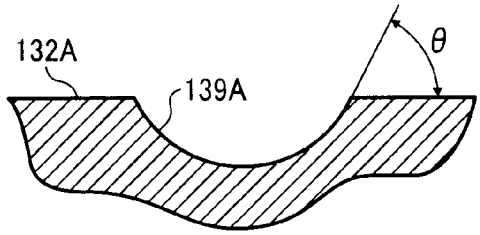
FIG. 12 illustrates the angle between the recess and the surface of the development sleeve.

In this case, referring to FIG. 12, it is preferred that an angle 0 between the inner face of the recesses 139A in the cross section in the circumferential direction of the development sleeve 132A and the circumferential surface of the development sleeve 132A be equal to or less than 60 degrees to alleviate unevenness in the image density in development caused by the effects of the development pole of the magnet roller 133.

In the configuration such as that shown in FIGS. 11A through 11C, in which the recesses 139A are arc-shaped in cross section in both the longitudinal direction and the circumferential direction of the development sleeve 132A, the amount of developer retained in the recesses 139A can be increased. Accordingly, a sufficient amount of developer can be carried on the development sleeve 132A.

Figure 13:
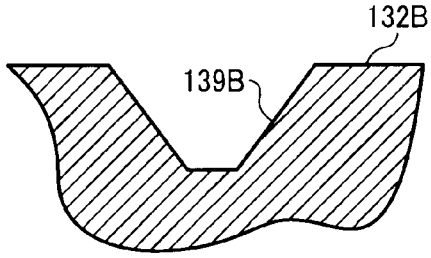
FIG. 13 illustrates another shape in cross section of the recess different from that shown in FIG. 12.
Figure 14:
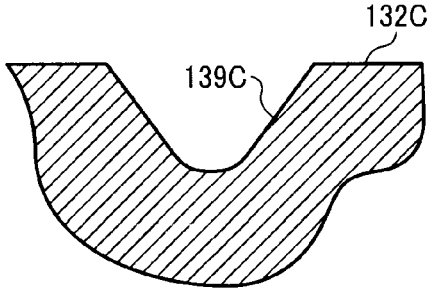
FIG. 14 illustrates yet another shape in cross section of the recess different from that shown in FIG. 12.

FIGS. 13 and 14 illustrate variations of the shape in cross section of the recesses 139 in the circumferential direction of the development sleeve 132. In FIG. 13, recesses 139B formed in a surface of a development sleeve 132B are substantially V-shaped in cross section and a bottom of the V-shape is flattened. In FIG. 14, recesses 139C formed in a surface of a development sleeve 132C are substantially V-shaped in cross section with a bottom of the V-shape arced.

Figure 15:
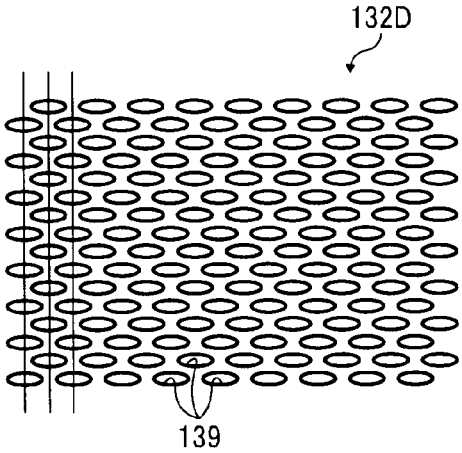
FIG. 15 is a plan view illustrating arrangement of the recesses according to a variation.
Figure 16:
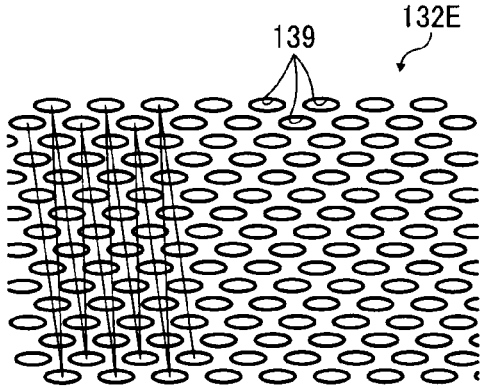
FIG. 16 is a plan view illustrating arrangement of the recesses according to another variation.

In addition, although, in the above-described configuration shown in FIG. 5, the multiple recesses 139 each slightly curved are aligned spirally on the surface of the development sleeve 132, alternatively, each recess 139 may be linear in the longitudinal direction and simultaneously the multiple recesses 139 may be aligned linear in the circumferential direction as in development sleeves 132D and 132E shown in FIGS. 15 and 16.

It is to be noted that, the inclination of the recesses 139 relative to the axial direction of the development sleeve 132D or 132E is omitted in FIGS. 15 and 16. In addition, the recesses 139 may be circular in shape in the plan view of the development sleeve 132.

Figure 26:
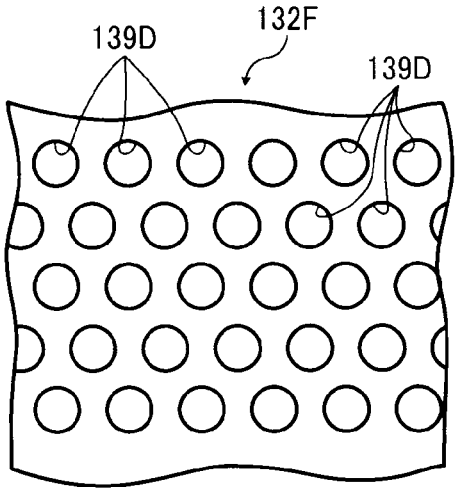
FIG. 26 is a plan view illustrates a variation of the opening shape of the recesses.

FIG. 26 illustrates a variation of the present embodiment, and circular recesses 139D are formed in the surface of a development sleeve 132F.

Next, descriptions are given below of restriction of cyclic unevenness in image density in the circumferential direction of the development sleeve resulting from the difference in the developer conveyance force between portions in which the recess is formed and other portions. In the configuration shown in FIGS. 5, 6A, and 7, the recesses 139 adjacent in the longitudinal direction of the development sleeve 132 is shifted in the circumferential direction of the development sleeve 132 and the recesses 139 are not connected linearly in the longitudinal direction of the development sleeve 132, thereby reducing the unevenness in image density resulting from the pitch of the recesses 139. Still, the image density can become uneven cyclically because the developer conveyance force is different between portions in which the recess 139 is formed and other portions 139.

Figure 17:
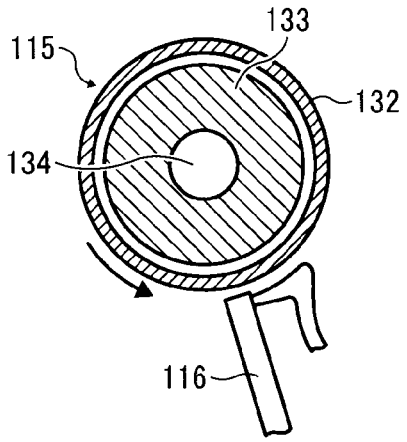
FIG. 17 illustrates the relative positions of the development roller and a doctor blade.
Figure 18:
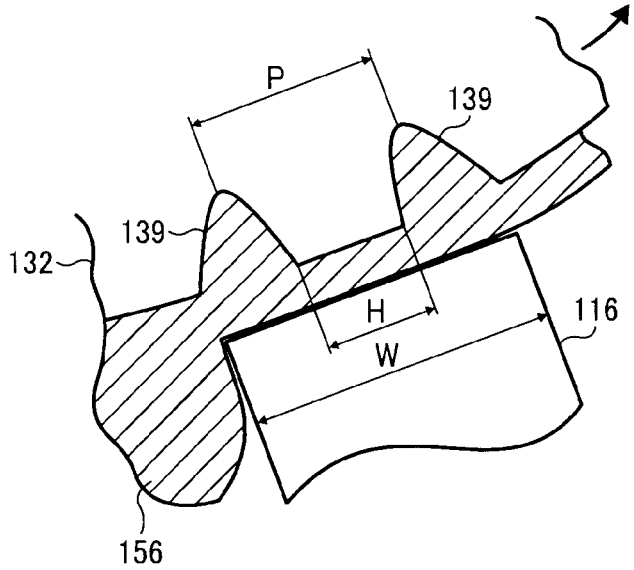
FIG. 18 illustrates the relative sizes of the doctor blade and the recesses on the development sleeve.

FIG. 17 illustrates the relative positions of the development roller 115 and the doctor blade 116 shown in FIG. 2. FIG. 18 is an enlarged view of an area in which the doctor blade 116 faces the development roller 115 and illustrates the action of the doctor blade 116 regulating the thickness of the developer layer on the development sleeve 132 as the development roller 115 rotates. In FIG. 18, reference character P represents a pitch of the recesses 139 in the circumferential direction of the development sleeve 132.

As shown in FIG. 18, in the present embodiment, the relative sizes of the doctor blade 116 and the recess 139 in the circumferential direction of the development sleeve 132 is designed so that a width W of the doctor blade 116 in the circumferential direction is greater than a distance (interval) H between the adjacent recesses 139 on the surface of the development sleeve 132 in the circumferential direction. Additionally, the width W of the doctor blade 116 is greater than the width of the recess 139 on the development sleeve 132 in the circumferential direction.

With this configuration, the doctor blade 116 cannot be contained in the distance H between the recesses 139 but be always present outside the distance H. In other words, the doctor blade 116 can inevitably face both the recess 139 and the distance H. Consequently, the recess 139, which has a greater force for holding the developer, can be involved in the adjustment of the layer thickness of the developer, and slippage of the developer on the development roller 115 (development sleeve 132) can be prevented or reduced. As a result, the cyclic unevenness in image density unevenness (caused by the pitch of the recesses 139) can be reduced.

In the present embodiment, to better alleviate the cyclic unevenness caused by the pitch of the recesses 139, the width W of the doctor blade 116 is equals to or greater than the pitch P of the recesses 139 in the circumferential direction ($W \geq P$).

With this relation, the recess 139 is inevitably included in the area where the doctor blade 116 faces the development sleeve 132 in the circumferential direction of the development sleeve 132.

In the configuration in which the recess 139, which can exert a greater developer conveyance force, is present in the area where the doctor blade 116 faces the development sleeve 132, slippage of the developer on the development roller 115 (development sleeve 132) can be better prevented or reduced. Therefore, the developer can be pumped up onto the surface of the development sleeve 132 uniformly and reliably, and images of satisfactory quality without the cyclic unevenness in the image density can be produced.

Additionally, in the present embodiment, the pitch of the recesses 139 becomes smaller toward both ends from a center portion in the longitudinal direction of the development roller 115.

When the developer is pumped up onto the development roller 115, pressure from the developer is present between the doctor blade 116 and the development roller 115. The pressure exerted on the development roller 115 by the developer deforms the development roller 115. When the development roller 115 is thus deformed, the regulation gap, which is the gap between the development roller 115 and the doctor blade 116, becomes larger in the center portion in the axial direction of the development roller 115 than that in the axial end portions. Accordingly, the amount of developer pumped up onto the development roller 115 is greater in the center portion than in the axial end portions, resulting in the unevenness in the image density in the longitudinal direction of the development roller 115.

In view of the foregoing, the pitch of the recesses 139 is varied in the axial direction of the development roller 115 in the present embodiment.

Figure 19A:
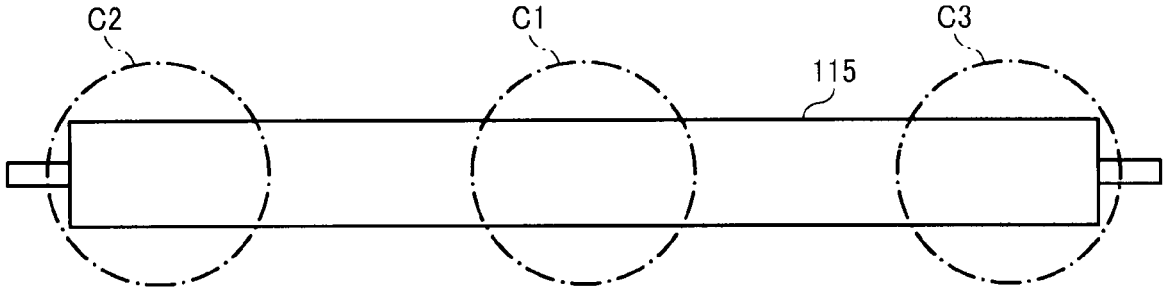
FIG. 19A is a schematic diagram of the development roller.
Figure 19B:
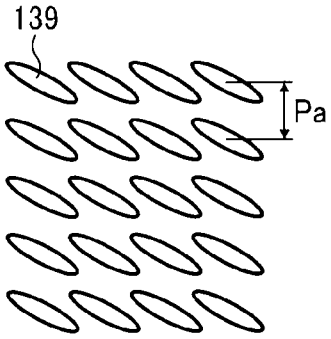
FIGS. 19B and 19C are plane views that illustrate a pitch of the recesses in the circumferential direction of the development roller in an axial center portion C1 and axial end portions C2 and C3 of the development roller shown in FIG. 19A.
Figure 19C:
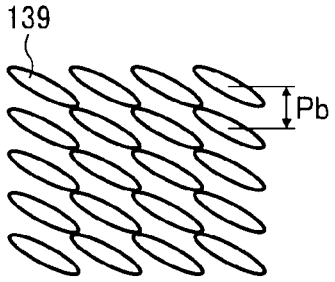

In FIGS. 19A, reference character C1 represents a center portion of the development roller 115 in the axial direction, and reference characters C2 and C3 represent axial end portions thereof. Reference character Pa in FIG. 19B represents a pitch of the recesses 139 in the circumferential direction in the center portion C1 of the development roller 115, and reference character Pb in FIG. 19C represents a pitch of the recesses 139 in the circumferential direction in the axial end portions C2 and C3.

The pitch Pa in the center portion C1 is greater than the pitch Pb in the axial end portions C2 and C3 ($Pa > Pb$) so that the developer conveyance force is greater in the axial end portions C2 and C3 than in the center portion C1. The pitch of the recesses 139 in the circumferential direction of the development roller 115 may be reduced gradually from the axial center portion C1 of the development roller 115 to the axial end portions C2 and C3 of the development roller 115.

This configuration can increase the developer conveyance force in the axial end portions of the development roller 115, thus counteracting the fluctuations in the amount of developer pumped up to the development roller caused by the deformation of the development roller 115. With this effect, the amount of developer pumped up can be uniform in the longitudinal direction of the development roller 115, reducing the unevenness in the image density in the longitudinal direction. Therefore, satisfactory images can be produced.

A development device 113-1 according to a third embodiment is described below with reference to FIGS. 20 through 25.

It is to be noted that components similar to those of the above-described embodiment are given identical or similar reference characters, and thus descriptions thereof omitted.

Figure 20:
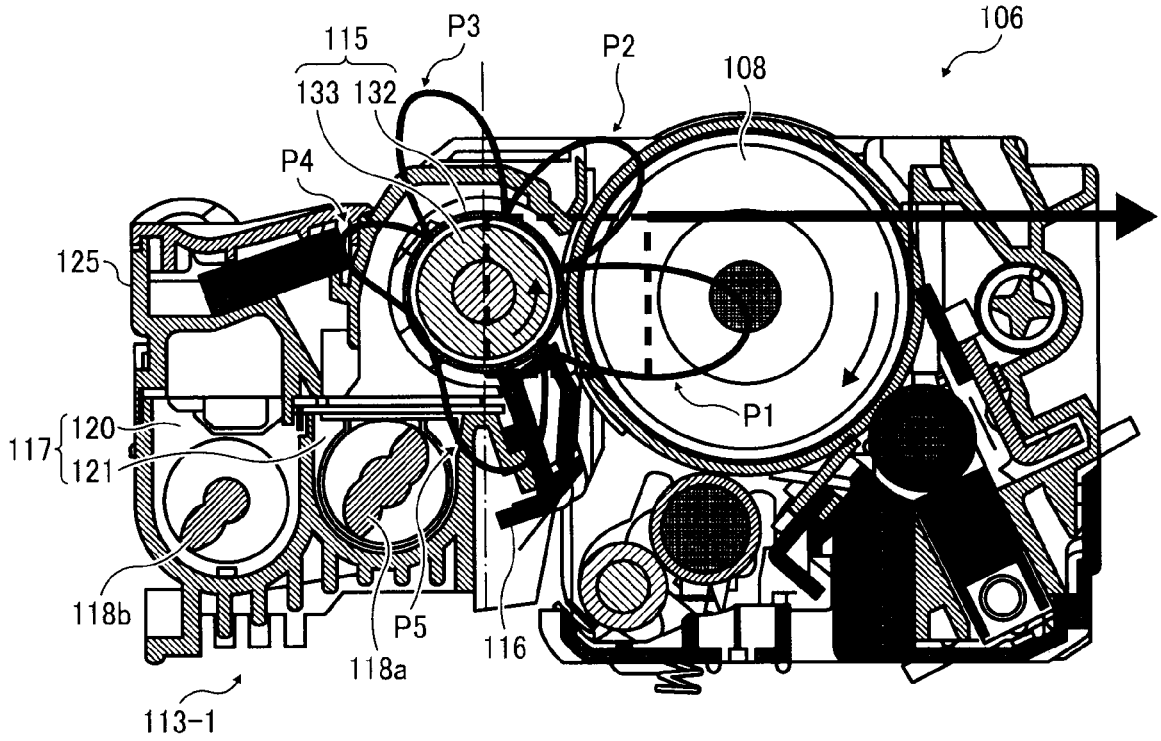
FIG. 20 is a schematic cross-sectional view of a process cartridge according to an embodiment.

FIG. 20 illustrates action of the magnetic poles of the development roller 115 in the present embodiment. In FIG. 20, reference characters P1 through P5 represent the magnetic poles of the magnet roller 133. For example, the magnetic poles P1 through P5 are respectively S, N, S, N, and N poles. The magnetic poles P1 through P5 serve as a development pole, a developer conveyance pole, another developer conveyance pole, an upstream release pole, and an attraction pole (downstream release pole). The amount of the developer carried on the development sleeve 132 is adjusted by the doctor blade 116, after which the developer is further transported as the development sleeve 132 rotates.

After developing the latent image formed on the photoreceptor drum 108, the developer passes by the opening formed in the casing 125 and is separated from the development sleeve 132 in a developer release portion by a magnetic force generated by the magnetic pole P4 (upstream release pole). Then, the developer is collected in the developer container 117 (second compartment 121) in which the supply screw 118*a* is provided.

In FIG. 20, curved lines shaped like petals around the magnet roller 133 represent the intensity of magnetic flux (magnetic flux density) generated by the magnet roller 133 in the direction normal to the development roller 115. The gap between the surface of the development sleeve 132 and the photoreceptor drum 108 is hereinafter referred to as a development gap.

The length of the development range in the circumferential direction of the development sleeve 132, in which the developer is caused to stand on end (like ears of wheat or the like) on the development sleeve 132 and slide on the photoreceptor drum 108 by the magnetic pole (development pole) P1 of the magnet roller 133, is hereinafter referred to as a development nip width N (shown in FIG. 21). In the present embodiment, for example, the development nip width N is from about 3 mm to 5 mm although it depends on the reference amount to which the amount of developer is regulated by the doctor blade 116, the size of the development gap, the radii of the development sleeve and the photoreceptor drum, and the type of developer.

In the development range, the distance (development gap Gp shown in FIG. 21) between the surface of the photoreceptor drum 108 (latent image bearer) and the surface of the development roller 115 can significantly affect the electric field in the development range. Therefore, the size of the development gap can significantly affect the developability of the development device.

To produce high-quality images, it is important to make the development gap constant by eliminating differences in the development gap in the longitudinal direction of the development sleeve 132. In addition, if the magnetic brush in the development range is sparse, it is possible that marks of the magnetic brush appear in the output images, degrading the image quality.

Although intervals between the recesses 139 formed in the surface of the development sleeve 132 can be adjusted by changing variables of the cutting tool such as the bite, the rotational frequency, the travel velocity, and the rotational velocity of the development sleeve 132, the magnetic brush in the development range can be sparse when intervals between the recesses 139 in the circumferential direction of the development sleeve 132 are greater than the development nip width N. In such a case, marks of the magnetic brush can appear in the output images, degrading the image quality.

Specific features of the present embodiment to eliminate the marks of the magnetic brush are described below.

Figure 21:
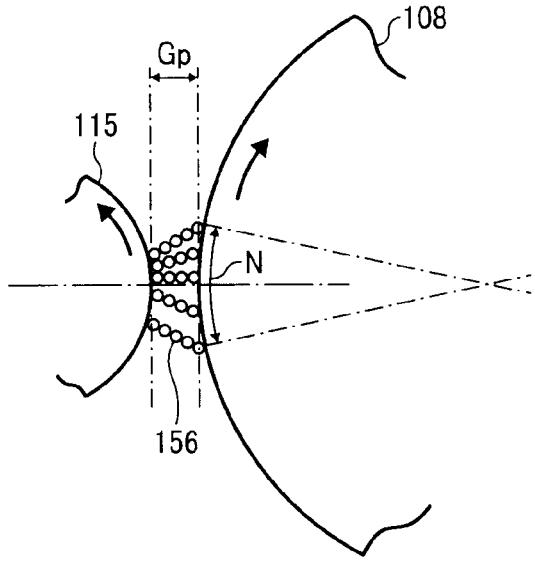
FIG. 21 illustrates a development gap and a development nip.
Figure 22:
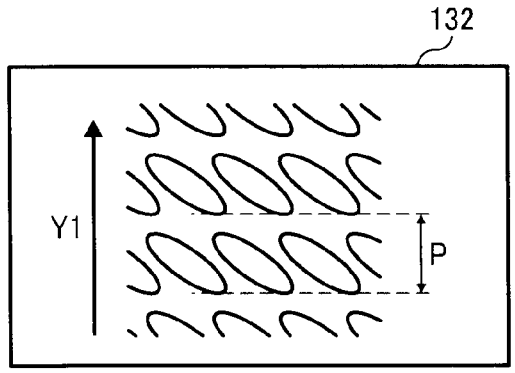
FIG. 22 is a plan view that illustrates the pitch of the recesses in the circumferential direction of the development sleeve.

Referring to FIGS. 21 and 22, in the present embodiment, when the pitch of the recesses 139 in the circumferential direction of the development sleeve 132 is P (shown in FIG. 22), the development nip width in the circumferential direction of the photoreceptor drum 108 is N (shown in FIG. 21), and the ratio of linear velocity of the development roller 115 to that of the photoreceptor drum 108 is α, $$\alpha \times N > P.$$

Development devices of this type has a feature that the developer particles tend to stand on end (like ears of wheat) in the grooves (recesses 139) formed in the development sleeve, forming bristles of the magnetic brush. That is, the grooves serve as the base of the developer particles standing on end. Therefore, when the above-described relation is satisfied, the density of the magnetic brush in the development nip width can be sufficient for eliminating or reducing the marks of the magnetic brush in the output images. In the present embodiment, the pitch P is about 0.5 mm so that an adequate quantity of recesses 139 can be present in the development nip width N.

A method for measuring the development nip width N is described below.

A toner layer such as solid image is formed on a photoreceptor drum preliminarily, and a development roller bearing developer is placed across a predetermined development gap from the photoreceptor drum. Prior to this process, the development gap is adjusted with the development roller that does not carry developer. Then, the developer is carried on the development roller, and the development roller is set at the position to attain the predetermined development gap.

Subsequently, only the development roller is rotated with the photoreceptor drum kept stationary. At that time, the toner layer formed on the photoreceptor drum is scraped off by the magnetic brush formed on the development roller.

Figure 23:
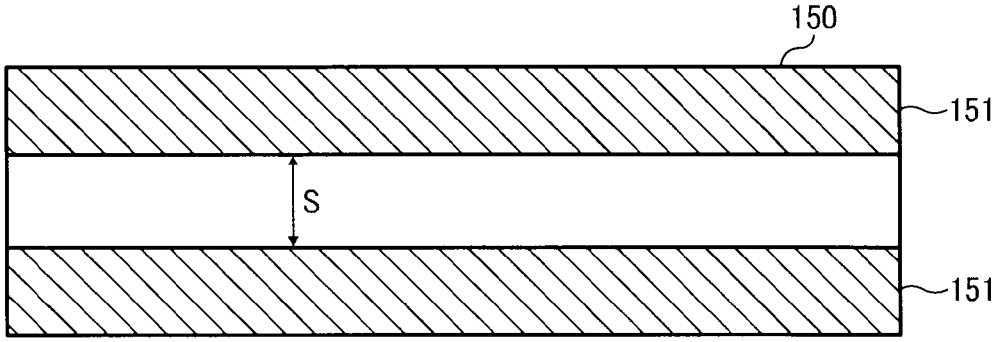
FIG. 23 is a plan view illustrating transferring of toner to a tape in measurement of development nip.

The photoreceptor drum is moved away from the development roller, and the portion where the toner layer is scraped off is covered with a transparent tape 150 (i.e., adhesive tape) shown in FIG. 23 to transfer the toner layer to the tape 150. When the tape 150 is removed from the photoreceptor drum, it can be known that the toner is absent in the portion where the development roller scraped off the developer. Referring to FIG. 23, in the tape 150, the development nip width N can be obtained by measuring a width S of the portion where developer 151 is absent.

In addition, in development devices of this type, the development gap tends to become greater than the predetermined size in the center portion in the axial direction of the development sleeve by the deformation of the development sleeve due to the pressure from the developer in the development range. Because the difference in the development gap in the longitudinal direction of the development sleeve causes differences in image density in that direction, it is preferred to eliminate the difference in the development gap in that direction.

In view of the foregoing, in the present embodiment, the density (quantity) of the recesses 139 in the longitudinal direction of the development sleeve 132 is varied as follows.

Figure 24:
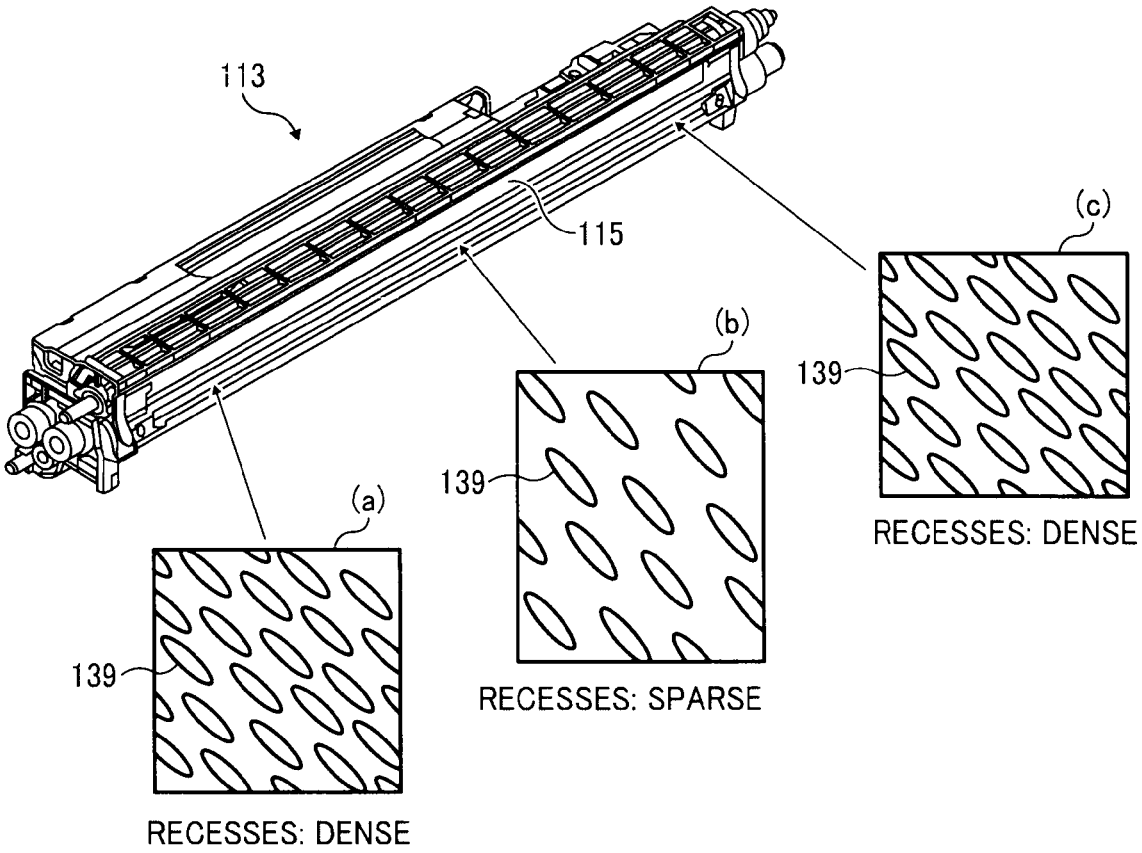
FIG. 24 illustrates differences in density of the recesses in the longitudinal direction of the development sleeve.

In FIG. 24, the density of the recesses 139 is smaller in an axial center portion (b) than in both axial end portions (a) and (c) supported by the casing 125. Alternatively, the density of the recesses 139 may be increased toward the axial end portions (a) and (c).

Reducing the density (quantity) of the recesses 139 can reduce the amount of developer pumped up to the development sleeve 132. Therefore, this configuration can intentionally reduce the amount of developer pumped up to the center portion of the development sleeve 132. The development sleeve 132 is more likely to deform and the development gap is more likely to expand in the center portion in the axial direction of the development sleeve 132 compared with the both axial end portions where the development sleeve 132 is supported. Therefore, reducing the amount of developer pumped up only in the center portion can alleviate the deformation of the center portion of the development sleeve 132 caused by the pressure of the developer, reducing the difference in size of the development gap in the longitudinal direction of the development sleeve 132.

Accordingly, satisfactory images of reduced fluctuations in image density can be produced.

If there are portions where no recess 139 is formed in the longitudinal direction of the development sleeve 132 in the development nip, the density of the magnetic brush becomes uneven.

To make the density of the magnetic brush constant, adjacent recesses 139 are shifted from each other in the circumferential direction of the development sleeve 132 indicated by arrow Y3 (hereinafter "circumferential direction Y3"). Simultaneously, end portions of the recesses 139 in the longitudinal direction Y2 overlap in the circumferential direction Y3.

Figure 25:
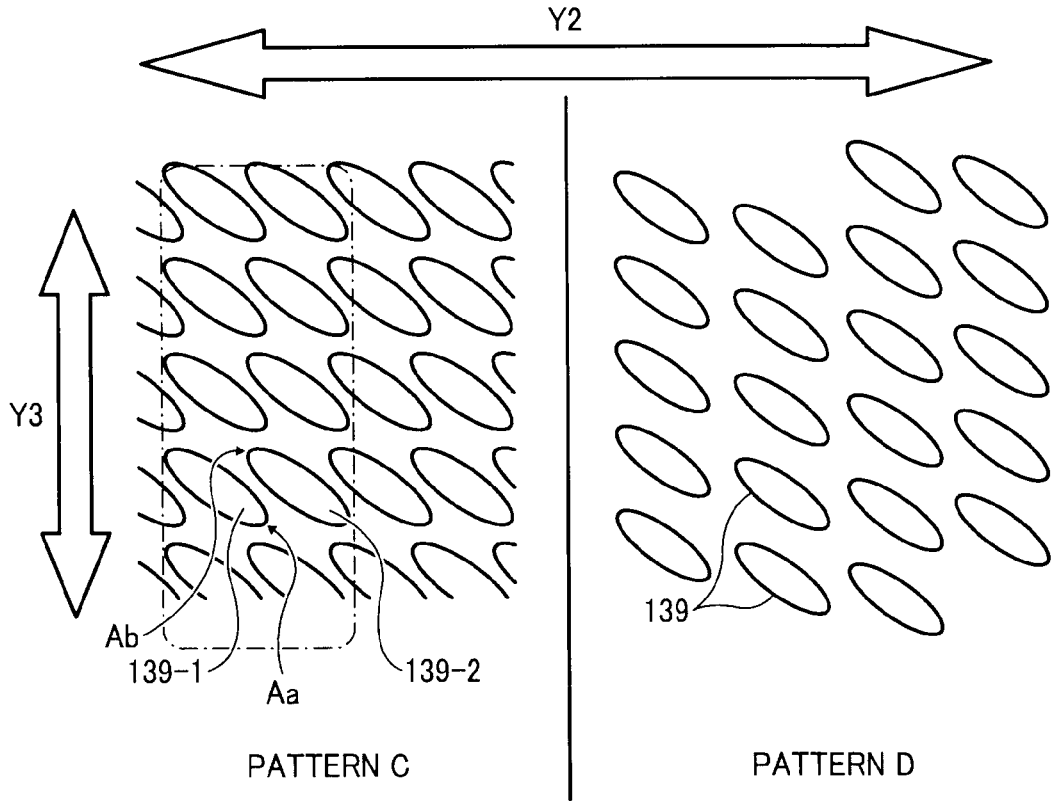
FIG. 25 is a plan view illustrating an arrangement pattern of the recesses in the longitudinal direction of the development sleeve.

Pattern C shown in FIG. 25 illustrates an arrangement of recesses according to the feature of the present embodiment. In the pattern C, a longitudinal end portion Aa of a recess 139-1 overlaps with a longitudinal end portion Ab of a recess 139-2 adjacent to the recess 139-1 in the circumferential direction Y3. By contrast, in a comparative pattern D, longitudinal end portions of adjacent recesses 139 do not overlap each other.

With the arrangement of the recesses 139 like the pattern C shown in FIG. 25, the recesses 139 can be uniformly distributed in the longitudinal direction of the development sleeve 132, thus forming a uniform magnetic brush in the development nip. Accordingly, unevenness in the image density like vertical lines can be eliminated or reduced. Thus, satisfactory images can be produced reliably.

Carry-over of developer that occurs in axial end portions of the development sleeve is described below.

Figure 27:
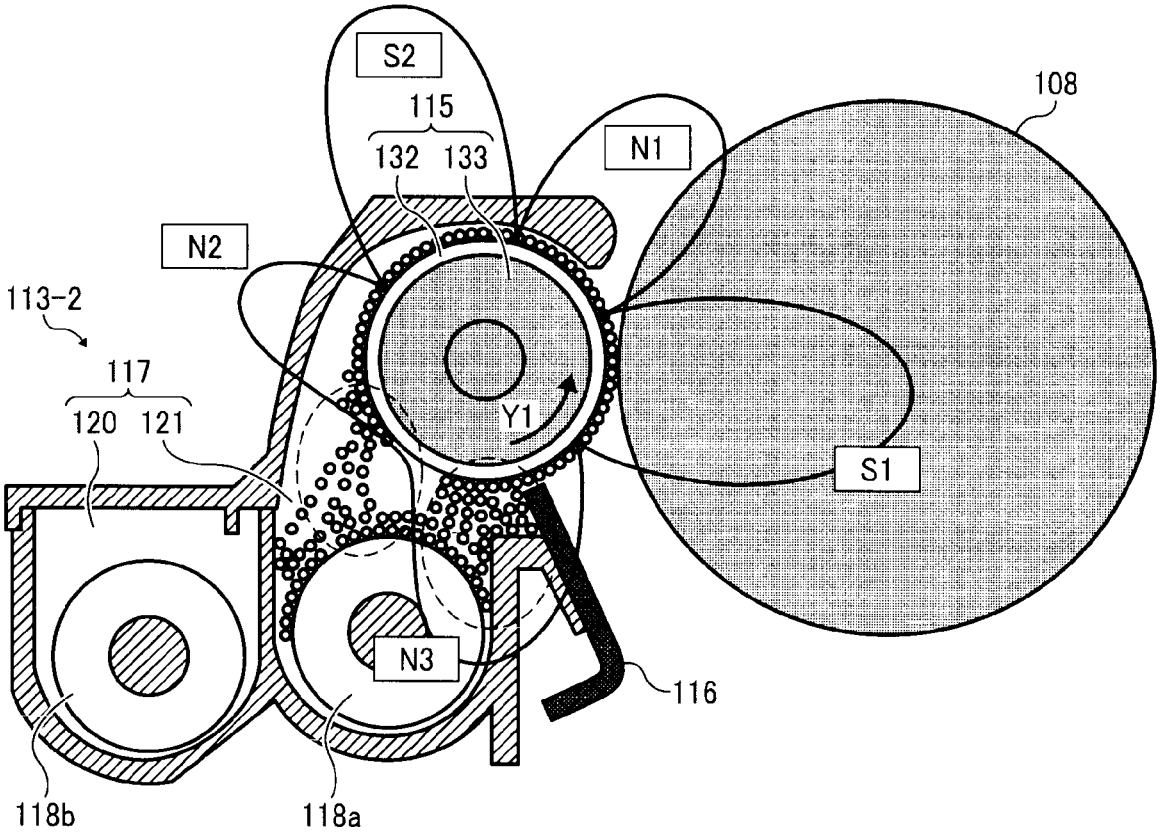
FIG. 27 is a cross-sectional view of a development device that illustrates configuration of magnetic poles.

In a development device 113-2 shown in FIG. 27, the magnet roller 133 has multiple fixed magnetic poles, for example, a magnetic pole S1 (development pole), a magnetic pole N1 (developer conveyance pole), a magnetic pole S2 (developer conveyance pole), a magnetic pole N2 (upstream release pole), and a magnetic pole N3 (attraction pole or downstream release pole) arranged in the rotational direction of the development sleeve 132. Since the development sleeve 132 rotates in the direction indicated by arrow Y1, the developer carried on the development sleeve 132 passes by the magnetic poles N3, S1, N1, S2, and N2 sequentially; and is separated from the development sleeve 132 in the developer release portion upstream from the attraction pole.

In the configuration shown in FIG. 27, a single magnetic pole serves as both the attraction pole and a developer regulation pole to reduce the stress on the developer and to secure the separation of developer from the development sleeve 132.

Figure 28A:
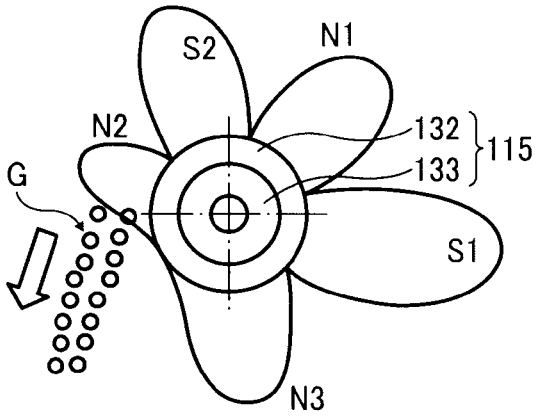
FIGS. 28A and 28B illustrate carry-over of developer that arises in axial end portions of the development sleeve.
Figure 28B:
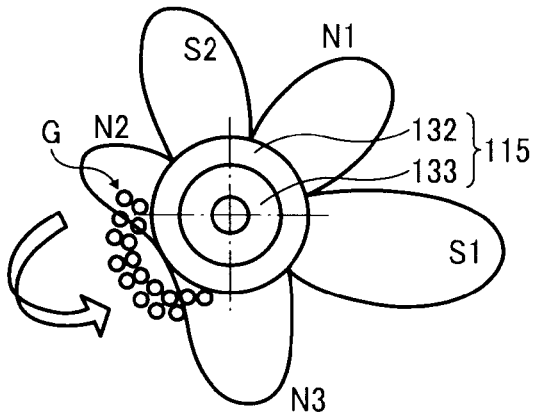

FIGS. 28A an 28B illustrate movement of developer G in the release portion where the developer is separated from the development sleeve 132. FIGS. 28A and 28B are cross-sectional views of an axial center portion and axial end portions of the development sleeve 132, respectively.

Except axial end portions, as shown in FIG. 28A, the developer G separated from the development sleeve 132 by the magnetic force exerted by the upstream release pole N2 falls to the developer container 117 and is mixed with the developer contained therein. Then, the developer G is again pumped up to the development roller 115 by the attraction pole N3.

In the axial end portions (outside the image formation area), however, the developer G separated from the development sleeve 132 by the magnetic force exerted by the upstream release pole N2 tends to move through outer portions where the magnetic force of the magnet roller 133 is not present toward the downstream release pole N3 as shown in FIG. 28B. As shown in FIG. 28B, most of the developer G does not leave the development roller 115 but is attracted to the development roller 115 by the downstream release pole N3, which is the phenomenon called "carry-over of developer". Where two adjacent magnetic poles have opposite polarities, the developer is attracted from the S pole to the N pole or from N pole to S pole and is transported downstream. Therefore, developer does not move outside in the axial direction of the development roller 115.

In the release portion, however, two adjacent magnetic poles have the same polarity and are repulsive to each other. Consequently, the component force to the outer side in the axial direction is increased, and the developer moves as described above. If the portion where carry-over of developer occurs contribute to image development, the image density of the resultant image decreases in the direction in which the sheet is transported because the developer is not replenished with toner from the developer container 117.

The relation between the recesses 139 and the carry-over of developer in the axial end portions is described below with reference to FIG. 29.

Figure 29:
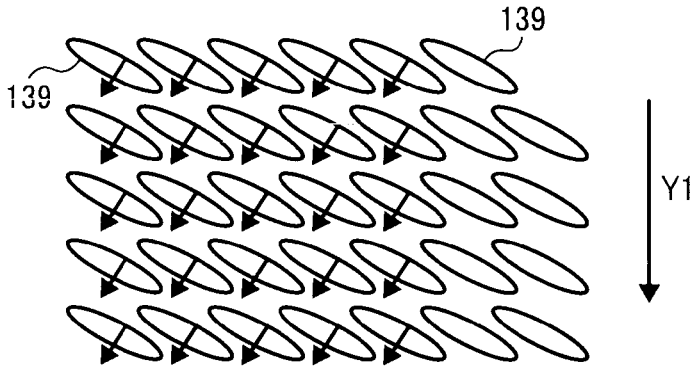
FIG. 29 is a plan view that illustrates conveyance of developer on a development sleeve in which the long axes of the recesses are oblique to the axial direction of the development sleeve.

FIG. 29 is an enlarged view of an area of about 2 $cm^2$ to 3 $cm^2$ of the surface of the development sleeve 132.

As shown in FIG. 29, when the rotational direction Y1 of the development sleeve 132 is downward and each recess 139 is oblique to the longitudinal direction of the development roller 115 with its left end portion positioned higher and its right end portion lower, the developer is urged to move in the direction indicated by arrows in the release portion. In this case, the developer tends to accumulate more in the axial end portion of the development sleeve 132 on the downstream side in the developer conveyance direction. Therefore, the possibility of occurrence of carry-over of developer is higher in the downstream end portion in the developer conveyance direction.

As described above, in the axial end portion, the possibility of carry-over of developer is higher. In addition, in development sleeves in which the recesses 139 are arranged uniformly in the longitudinal direction, a force for transporting the developer on the development sleeve in the longitudinal direction thereof is generated. Accordingly, the developer is more likely to move to the axial end portion, which increases the possibility of occurrence of carry-over of developer.

A specific feature of the present embodiment to prevent carry-over of developer is described with reference to FIG. 30.

Figure 30:
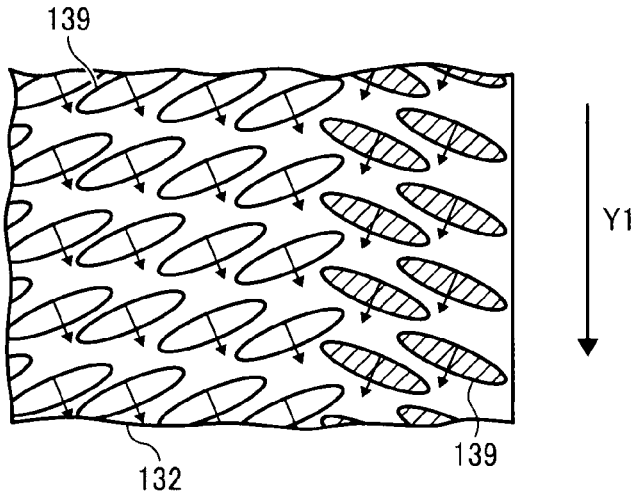
FIG. 30 is an enlarged view of recesses formed in a development sleeve according to another embodiment.

As shown in FIG. 30, the hatched recesses 139 in the downstream axial end portion of the development sleeve 132 in the direction in which the developer on the development sleeve 132 moves has an inclination (relative to the axial direction of the development sleeve 132) reversed from that of the recesses 139 positioned on the inner side, closer to the axial center portion of the development sleeve 132. In other words, the inclination of the recesses 139 in the downstream end portion in the direction in which the developer on the development sleeve 132 moves is changed to generate a developer conveyance force that counteracts the developer conveyance force generated by the recesses 139 on the inner side.

With this configuration, the direction of the developer conveyance force in the end portion on the downstream side can be reversed. Accordingly, the amount of developer transported to the downstream end portion can be reduced, inhibiting the occurrence of carry-over of developer. Because the occurrence of carry-over of developer in the downstream end portion in the direction in which the developer on the development sleeve 132 moves can be reduced, it is not necessary to expand the development roller outside the imaging area in the longitudinal direction of the development roller. Accordingly, the device can be kept compact. This configuration can also prevent or inhibit the developer from entering a sealed end portion.

Figure 31:
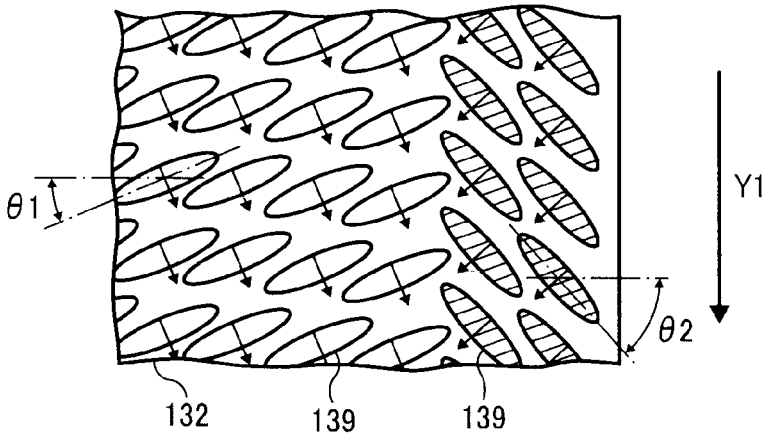
FIG. 31 is an enlarged view of recesses formed in a development sleeve according to a variation of the configuration shown in FIG. 30.

FIG. 31 illustrates a variation of the above-described embodiment. It is to be noted that components similar to those of the above-described embodiment are given identical or similar reference characters, and thus descriptions thereof omitted.

Similarly to the above-described configuration, in the configuration shown in FIG. 31, the inclination of the recesses 139 (indicated with hatching) relative to the axial direction of the development sleeve 132 in the downstream end portion of the development sleeve 132 in the developer conveyance direction is reversed from the inclination of the recesses on the inner side in the developer conveyance direction. In addition, the inclination of the hatched recesses 139 on the downstream side is increased from the inclination of the inner recesses 139 to increase the counteraction against the developer conveyance force toward the downstream end portion.

In other words, when the inclination of the hatched recesses 139 in the downstream end portion in the above-described embodiment is $\theta 1$ and that in the present embodiment is $\theta 2$ , $\theta 1 < \theta 2$.

With this configuration, the developer conveyance force in the reverse direction generated in the downstream end portion can be increased. Accordingly, the developer can be reliably prevented from entering in the sealed end portion.

It is to be noted that, although the description above concerns configurations in which the long axes of the recesses 139 are oblique for generating the developer conveyance force in the longitudinal direction of the development sleeve 132, alternatively, the feature of the present embodiment can adapt to configurations in which the recesses 139 are positioned in parallel to the axial direction of the development sleeve 132.

That is, inclination of only the recesses 139 in the downstream end portion may be changed from the recesses 139 parallel to the axial direction of the development sleeve in the center portion. In such a configuration, carry-over of developer can be reduced as well.

As described above, in the embodiments of the present invention, the force for transporting the developer in the axial direction of the development sleeve can be generated, thereby reducing the stress on the developer. Simultaneously, unevenness in image density in the longitudinal direction of the image area can be restricted.

Next, the toner used in the present embodiment is described in further detail with reference to FIGS. 32 and 33.

To attain fine dots of 600 dpi or greater, it is preferable that the toner particles have the volume average particle size within a range from 3 μm to 8 μm. Additionally, the ratio of the volume average particle diameter (Dv) to the number average particle diameter (Dn) is within a range of from 1.00 to 1.40 (Dv/Dn). As the volume average particle diameter (Dv/Dn) becomes closer to 1.00, the particle diameter distribution becomes sharper.

In the case of toner particles having such a small diameter and a narrow particle diameter distribution, the distribution of electrical charge can be uniform, thus producing high-quality images with reduced scattering of toner in the backgrounds. Further, in electrostatic transfer methods, the transfer ratio can be improved.

The toner desirably has a first shape factor SF-1 and a second shape factor SF-2 both within a range of 100 to 180. The first shape factor SF-1 and the second shape factor SF-2 are described with reference to FIGS. 32 and 33.

Figure 32:
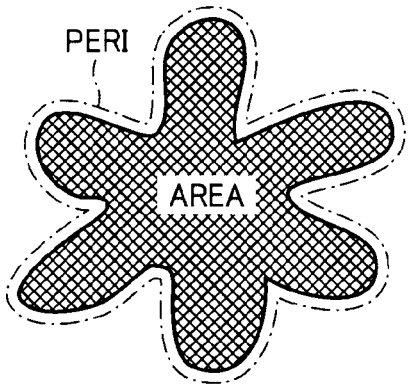
FIG. 32 is a schematic diagram that illustrates the shape of toner for understanding of toner shape factor SF-1.
Figure 33:
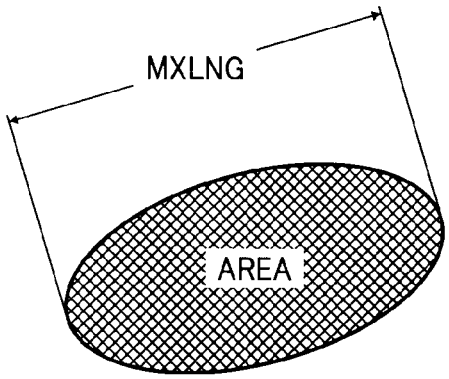
FIG. 33 is a schematic diagram that illustrates the shape of toner for understanding of toner shape factor SF-2.
Figure 34A:
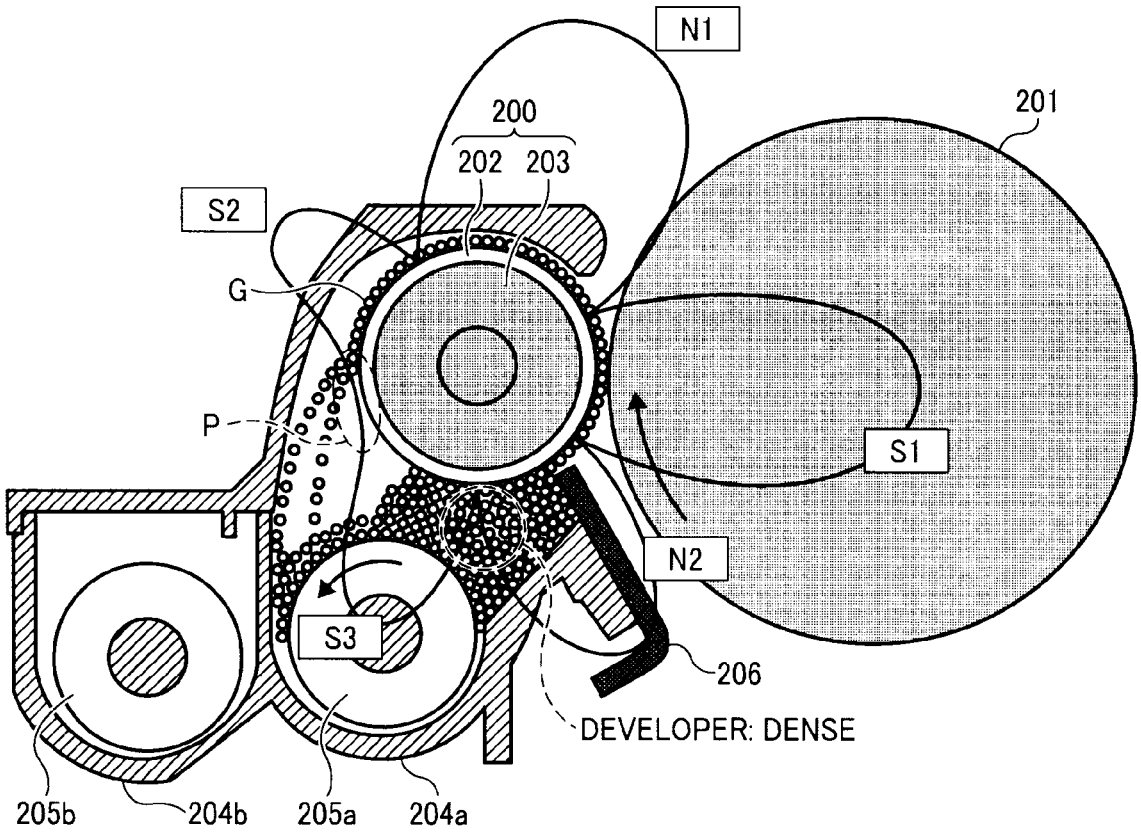
FIG. 34A RELATED ART
FIG. 34A is a cross-sectional view of a development device according to a related art.
Figure 34B:
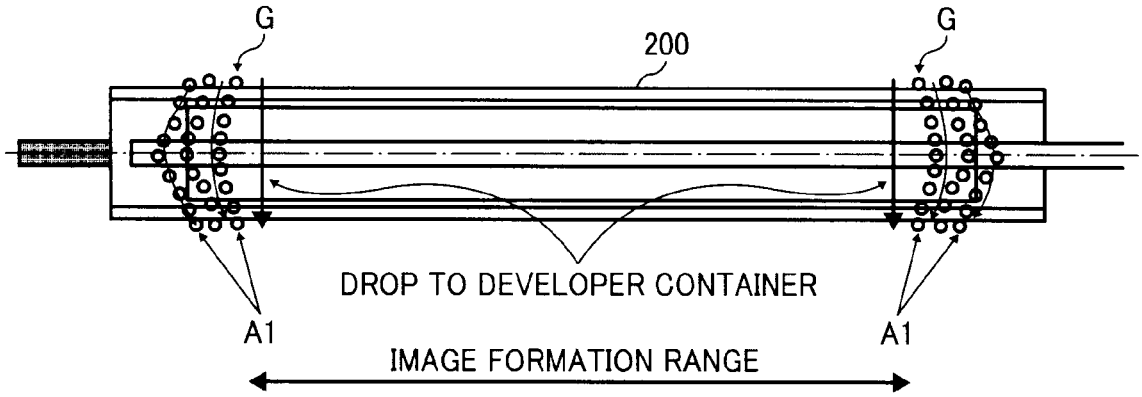
FIG. 34B RELATED ART
FIG. 34B illustrate carry-over of developer that arises in axial end portions of a development sleeve according to the related art.

As shown in FIG. 32, the first shape factor SF-1 shows a degree of roundness and is expressed by formula 1;

$$SF\text{-}1=\{(MXLNG)^2/AREA\}\times(100\pi/4) \qquad \text{Formula 1}$$

wherein MXLGN is a maximum length of toner particle projected on a two-dimensional surface and AREA is an area of toner particle.

The toner particle is a sphere when the first shape factor SF-1 is 100. The larger the SF-1 becomes, the more the toner particle becomes amorphous.

The second shape factor SF-2 shows a degree of irregularity and is expressed by formula 2;

$$SF\text{-}2=\{(PERI)^2/AREA\}\times(100\pi/4) \qquad \text{Formula 2}$$

wherein PERI is a peripheral length of toner particle projected on a two-dimensional surface and AREA is the area of the toner particle.

The surface of the toner particle is smooth without surface unevenness when the second shape factor SF-2 is 100. As the second shape factor SF-2 increases, the surface unevenness increases.

The first shape factor SF-1 and second shape factor SF-2 were measured based on a photograph taken by a scanning electron microscope, S-800 (Hitachi, Ltd.) in an exemplary embodiment. The photograph was analyzed by an image analyzer, LUSEX3 manufactured by NIKON CORPORATION.

The contact areas among toner particles are small when toner particles are substantially spherical in shape. Therefore, absorption power among toner particles is weak and fluidity is high. Further, the absorption power of the toner particles to the photoreceptor is weak as well, and transfer efficiency can be improved. On the other hand, when either or both of the first shape factor SF-1 and second shape factor SF-2 exceed 180, the transfer efficiency decreases.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device to develop a latent image formed on a latent image bearer with two-component developer, the development device comprising:

a casing;

a developer container housed in the casing, for containing the developer;

a hollow, cylindrical developer bearer positioned facing the latent image bearer to transport by rotation the developer to a development range where the developer forms a magnetic brush and slides on the latent image bearer;

a magnetic field generator disposed inside the developer bearer;

a developer agitator to supply the developer contained in the developer container to the developer bearer while transporting the developer in an axial direction of the developer bearer; and a developer regulator positioned upstream from the development range in a rotational direction of the developer bearer across a predetermined gap from an outer circumferential surface of the developer bearer to adjust a layer thickness of the developer carried on the developer bearer, wherein multiple oval recesses oblique to the axial direction of the developer bearer are formed in the outer circumferential surface of the developer bearer and arranged in a circumferential direction of the developer bearer and the axial direction of the developer bearer, wherein an upstream inner wall of each of the multiple recesses on an upstream side in the rotational direction of the developer bearer applies a force to the developer as the developer bearer rotates, wherein an angle between a long medial axis of each of the multiple recesses and the axial direction of the developer bearer is set so that the force applied by the upstream inner wall of each recess has a component in a direction substantially identical to the direction in which the developer agitator transports the developer, wherein the long medial axis of each of the multiple recesses is curved, wherein the long medial axis of each of the multiple recesses is curved so that a center portion thereof is bowed upstream in the rotational direction of the developer bearer, and wherein the long medial axis of each of the multiple recesses is curved so that the angle between the long medial axis of each of the multiple recesses and the axial direction of the developer bearer is greater on an upstream side than on a downstream side in the direction in which the developer agitator transports the developer.

2. The development device according to claim 1, wherein the angle between the long medial axis of each of the multiple recesses and the axial direction of the developer bearer is greater than 10 degrees and smaller than 45 degrees.

3. The development device according to claim 1, wherein the magnetic field generator comprises:

an upstream release pole positioned downstream from the development range in the rotational direction of the developer bearer to generate a magnetic force for separating the developer from the developer bearer that has passed through the development range; and a downstream release pole positioned adjacent to and downstream from the upstream release pole in the rotational direction of the developer bearer, the downstream release pole having a polarity identical to a polarity of the upstream release pole, wherein the multiple recesses positioned in a downstream end portion of the developer bearer in the direction in which the developer agitator transports the developer are arranged to generate a force to transport the developer carried on the developer bearer in the axially inward direction of the developer bearer.

4. The development device according to claim 3, wherein the multiple recesses are arranged regularly on the outer surface of the developer bearer, in an inner portion of the developer bearer in the axial direction thereof, an upstream end portion and a downstream end portion of each of the multiple recesses in the direction in which the developer agitator transports the developer are positioned downstream and upstream, respectively, in the rotational direction of the developer bearer, and in the downstream end portion of the developer bearer in the axial direction of the developer bearer, the upstream end portion and the downstream end portion of each of the multiple recesses in the direction in which the developer agitator transports the developer are positioned upstream and downstream, respectively, in the rotational direction of the developer bearer.

5. The development device according to claim 4, wherein the angle between the long medial axis of each of the multiple recesses and the axial direction of the developer bearer is greater in the downstream end portion of the developer bearer than in the inner portion of the developer bearer in the direction in which the developer agitator transports the developer.

6. The development device according to claim 1, wherein a length of the developer regulator in the circumferential direction of the developer bearer is greater than a distance between adjacent recesses in the outer circumferential surface of the developer bearer.

7. The development device according to claim 6, wherein the length of the developer regulator in the circumferential direction of the developer bearer is equal to or greater than a pitch between adjacent recesses in the circumferential direction of the developer bearer.

8. The development device according to claim 6, wherein a pitch of adjacent recesses in the circumferential direction of the developer bearer is smaller in an end portion than in a center portion of the developer bearer in the axial direction thereof.

9. The development device according to claim 6, wherein when P represents a pitch of adjacent recesses in the circumferential direction of the developer bearer, N represents a length of the development range in the circumferential direction of the developer bearer, and a represents a ratio of a linear velocity of the developer bearer to a linear velocity of the latent image bearer, $$\alpha \times N > P.$$

10. The development device according to claim 6, wherein adjacent recesses in the axial direction of the developer bearer are shifted in the circumferential direction of the developer bearer, and end portions of the adjacent recesses in the axial direction of the developer bearer overlap each other in the circumferential direction of the developer bearer.

11. A process cartridge removably installable in an image forming apparatus, comprising the development device according to claim 1, wherein the development device and the latent image bearer are housed in a common casing.

12. An image forming apparatus comprising:

the latent image bearer; and the development device according to claim 1.

13. A development device to develop a latent image formed on a latent image bearer with two-component developer, the development device comprising:

a casing;

a developer container housed in the casing, for containing the developer;

a hollow, cylindrical developer bearer positioned facing the latent image bearer to transport by rotation the developer to a development range where the developer forms a magnetic brush and slides on the latent image bearer;

a magnetic field generator disposed inside the developer bearer;

a developer agitator to supply the developer contained in the developer container to the developer bearer while transporting the developer in an axial direction of the developer bearer; and a developer regulator positioned upstream from the development range in a rotational direction of the developer bearer across a predetermined gap from an outer circumferential surface of the developer bearer to adjust a layer thickness of the developer carried on the developer bearer, wherein multiple oval recesses oblique to the axial direction of the developer bearer are formed in the outer circumferential surface of the developer bearer and arranged in a circumferential direction of the developer bearer and the axial direction of the developer bearer, an upstream long inner wall of each of the multiple recesses on an upstream side in the rotational direction of the developer bearer applies a force to the developer as the developer bearer rotates, and an angle between a long medial axis of each of the multiple recesses and the axial direction of the developer bearer is set so that the force applied by the upstream long inner wall extending in a direction along the medial axis of each recess has a component in a direction substantially identical to the direction in which the developer agitator transports the developer.

14. A development device to develop a latent image formed on a latent image bearer with two-component developer, the development device comprising:

a cylindrical developer bearer configured to be positioned facing the latent image bearer to transport by rotation the developer to a development range where the developer forms a magnetic brush and slides on the latent image bearer;

a casing configured to hold the developer bearer rotatably and include a first housing section near the developer bearer and a second housing section opposite to the first housing section, the first housing section and the second housing section communicating in a first end portion in an axial direction of the developer bearer and a second end portion opposite the first end portion in the axial direction;

a first agitator disposed in the first housing section and configured to supply the developer contained in the first housing section to the developer bearer while transporting the developer from the first end portion to the second end portion;

a second agitator disposed in the second housing section and configured to transport the developer from the second end portion to the first end portion;

a developer regulator positioned upstream from the development range in a rotational direction of the developer bearer across a predetermined gap from an outer circumferential surface of the developer bearer to adjust a layer thickness of the developer carried on the developer bearer, wherein multiple oval recesses are regularly formed in an outer circumferential surface of the developer bearer, and wherein a long medial axis of each of the multiple recesses is inclined with respect to the axial direction so as to transport the developer on the outer circumferential surface of the developer bearer from the side of the first end portion to the side of the second end portion.

* * * * *